US005558980A

United States Patent [19]

Nielson et al.

[11] Patent Number: 5,558,980

[45] Date of Patent: Sep. 24, 1996

[54] METHOD FOR PREPARING PHOTOGRAPHIC ELEMENTS COMPRISING LOADED LATEX COMPOSITIONS

[75] Inventors: Ralph B. Nielson, Rochester; Thomas A. Rosiek, Honeoye; James S. Honan, Spencerport, all of N.Y.

[73] Assignee: Eastman Kodak Company, Rochester, N.Y.

[21] Appl. No.: 390,722

[22] Filed: Feb. 17, 1995

[51] Int. Cl.[6] ..... G03C 7/388

[52] U.S. Cl. ..... 430/545; 430/546; 430/935

[58] Field of Search ..... 430/546, 545, 430/935

[56] References Cited

U.S. PATENT DOCUMENTS 5,001,045 3/1991 Furutachi et al. ..... 430/546

5,200,303 4/1993 Takahashi et al. ..... 430/546

5,260,177 11/1993 Aoki et al. ..... 430/556

FOREIGN PATENT DOCUMENTS 0341088 11/1989 European Pat. Off. ..... 430/546

*Primary Examiner*—Lee C. Wright

*Attorney, Agent, or Firm*—Andrew J. Anderson

[57] ABSTRACT

Photographic elements comprising loaded latex compositions are prepared by (a) combining under conditions of low or moderate shear, in the presence of surfactant, and in the substantial absence of water-miscible or volatile organic solvents, a liquid organic composition comprising at least one photographically useful compound with an aqueous polymer latex, (b) holding the combination resulting from (a) in a liquid state for sufficient time for substantial loading of the organic coposition into the polymer latex to occur, and (c) coating the loaded latex resulting from (b) on a support.

26 Claims, No Drawings

METHOD FOR PREPARING PHOTOGRAPHIC ELEMENTS COMPRISING LOADED LATEX COMPOSITIONS

FIELD OF THE INVENTION

The present invention relates to a method for forming photographic dispersions and photographic elements comprising hydrophobic photographically useful compounds dispersed in an aqueous solution. More particularly, it relates to the use of polymer latexes in such a method.

BACKGROUND OF THE INVENTION

One approach to preparing photographic dispersions containing polymer is to load a hydrophobic photographically useful compound into a polymer latex. Manufacturing advantages of loaded latex dispersions can include avoiding the high-shear or turbulent mixing required to prepare conventional emulsified photographic dispersions, and the reduction or elimination of high-boiling solvents, known as coupler solvents. Also, photographic advantages of polymer-containing photographic dispersions can be obtained with loaded latex compositions, including improved image permanence, improved dye hue and color reproduction, and improved dry and wet film physical properties.

The use of latex or dispersed polymers in the preparation of photographic dispersions has been described in U.S. Pat. Nos. 2,772,163; 2,852,382; 4,133,687; 4,199,363; 4,203,716; 4,214,047; 4,247,627; 4,368,258; 4,448,850; 4,497,929; 4,608,424; 4,684,608; 4,724,197; 4,822,728; 4,840,885; 4,891,309; 4,914,005; 4,990,435; 5,026,631; 5,047,316; 5,091,296; 5,279,931; British Patent GB 1,287,013; Canadian Patent No. 616,178; European Patent Application EP 483,416; Japanese patent application JP 032 558; and Research Disclosure 181,072. Usually these latex polymers are prepared by emulsion polymerization, although emulsified dispersions of organic-soluble polymers are also described, as in U.S. Pat. Nos. 4,388,403; 4,840,885 and 5,026,631.

The usual procedure for preparing a loaded latex described in the prior art is to combine a solution of the hydrophobic photographically useful compound in a water-miscible organic solvent with the aqueous latex. The resulting mixture that typically has about a 1:1 ratio of water to organic solvent, is either diluted with water or the organic solvent is removed by evaporation, with the result that the hydrophobic compound becomes associated with or dissolved in the latex particles. Variations on this procedure vary the order of addition of the organic solution and aqueous latex, substitute volatile, but not entirely water-immiscible auxiliary solvents for the water-miscible auxiliary solvents, incorporate water-miscible or volatile organic solvent in the emulsion polymerization step that is also present during dispersion preparation, or require the formation of intermediate water-in-oil emulsions of the latex in volatile organic solvent before the formation of the final oil-in-water loaded latex dispersion. In some cases, photographically useful compounds are dissolved in the organic monomers prior to emulsion polymerization. Procedures are also described in which base-ionizable couplers and/or base-ionizable latex polymers are combined at high pH, often with auxiliary solvent present, followed by neutralization and/or addition of magnesium salts or alkaline-earth metal salts, to form a dispersion of coupler and polymer.

All of these procedures for preparing loaded-latex or latex-containing dispersions present severe practical difficulties. Rigid requirements exist for both the hydrophobic compound to be loaded and the latex, especially for the procedures that use water-miscible organic solvent. In the initial mixture of hydrophobic compound, water-miscible organic solvent, and latex, the hydrophobic compound must not be precipitated by the aqueous environment, and the latex must not be coagulated by the large amount of organic solvent present. Many patents in the prior art describe a test for latex loadability, in which a suitable latex must not coagulate when mixed with an equal volume of the water-miscible organic solvent used in the dispersion preparation. Most latex polymers do not meet this requirement. A second difficulty is that auxiliary solvent is used in the process at all, causing severe manufacturing, environmental and safety problems. A third concern is that free-radical emulsion polymerization of monomers with photographically useful compounds dissolved in the monomers can cause chemical destruction of the compounds and can impair the polymerization process, leading to unwanted crosslinking, or lowered polymer molecular weight, and to higher levels of residual monomer. Polymerization processes other than free-radical polymerizations, including most condensation polymerizations, are poorly adapted to production of emulsion polymers, and also present similar difficulties with unwanted reactions of the photographically useful compounds under polymerization conditions or with the polymerization reagents, and unwanted effects of the compounds on the polymerization process, including chain termination or crosslinking. None of this prior art describes procedures for loading latex polymers without the use of substantial amounts of water-miscible or volatile auxiliary solvent at some point in the procedure. A fourth problem is that it is often difficult or impossible to achieve high loading levels, i.e., greater than about a 1:1 ratio, of the hydrophobic compound or compounds in the latex, using the known methods.

We have recently discovered that subjecting a mixture liquid oil-phase and an aqueous polymer latex to conditions of high shear and/or turbulence can lead to formation of loaded latex compositions, even in the absence of water-miscible or volatile organic solvent. This method is applicable to a wider variety of latex polymers and hydrophobic photographically useful compounds than the other methods described above, and higher loading levels can be achieved. This method, however, still requires the energy to cause high-shear and/or turbulent mixing of the dispersion containing the latex and the photographically useful compound.

SUMMARY OF THE INVENTION

With the present invention we have unexpectedly discovered that hydrophobic photographically useful compounds and polymer latex dispersions, in the presence of surfactant, form loaded latex dispersions after simple low-shear mixing of the latex with a liquid oil-phase, in the absence of any significant amount of water-miscible or volatile solvent, when such mixtures are held in a liquid state for a sufficient length of time.

One embodiment of the invention comprises a method for preparing a photographic element comprising at least one hydrophilic colloid layer coated on a support, comprising (a) combining under conditions of low or moderate shear, in the presence of surfactant, and in the substantial absence of water-miscible or volatile organic solvents, a liquid organic composition comprising at least one photographically useful compound with an aqueous polymer latex, (b) holding the combination resulting from (a) in a liquid state for sufficient time for substantial loading of the organic composition into the polymer latex to occur, and (c) coating the loaded latex resulting from (b) on a support.

In a preferred embodiment of the invention, a coarse aqueous dispersion of liquid oil phase (e.g., a dispersion containing liquid oil phase particles of from 0.4 to 20 microns) comprising a photographically useful compound that is essentially free of water-miscible or volatile solvent, is prepared by low- or moderate-shear mixing of the hydrophobic oil solution with an aqueous solution containing surfactant to promote loading, and the polymer latex is mixed with this coarse dispersion, leading to the formation of loaded latex after some time. In another preferred embodiment, the liquid oil solution is mixed directly, under conditions of low to moderate shear, with an aqueous solution containing the polymer latex and surfactant, leading to the formation of the loaded latex after some time. In yet another preferred embodiment, a fine-particle photographic dispersion of a liquid hydrophobic solution comprising a photographically useful compound (e.g., a dispersion containing liquid oil phase particles of from 0.05 to 0.4 microns) is prepared by means known in the art (including high-shear and or turbulent mixing) and in such a way that the dispersion is essentially free of water-miscible or volatile solvent, and the dispersion is mixed under conditions of low shear with an aqueous latex in the presence of surfactant to cause loading of the latex.

In a preferred embodiment of the invention, the combination resulting from (a) is held for a sufficient time for essentially complete loading of the organic composition into the polymer latex to occur in order to achieve more consistent photographic properties in the resulting elements. It has been found that loading of a liquid organic composition into a latex polymer may require holding for an extended length of time in a liquid state for substantial loading, and even greater length of time for essentially complete loading to occur. For the purposes of this invention, "substantial" loading is defined as the amount of loading of a photographically useful compound into a polymer latex necessary to generate a measurable difference in the photographic properties of the resulting photographic element compared to a non-loaded mixture of photographically useful compound and polymer latex, while "essentially complete" loading is defined as the level of loading required to attain 75% of the difference in the photographic properties of a photographic element comprising a completely loaded latex compared to a photographic element comprising a non-loaded mixture of photographically useful compound and polymer latex.

In a most preferred embodiment of the invention, the liquid organic composition loaded into the polymer latex comprises a photographic coupler.

With the extensive prior art describing loaded latex compositions prepared by using large amounts of water-miscible or volatile organic solvent, in processes that were complex, tedious, labor intensive, energy intensive, and environmentally objectionable, we were surprised to see the formation of loaded-latex dispersions made possible by such a simple procedure. Certainly, not all combinations of photographically useful compounds, latex polymers, and surfactants lead to formation of loaded latex formulations, but for combinations where loading does occur, this method provides an extremely simple and attractive procedure.

One object of the invention is the control of photographic dispersion particle size by the use of a latex polymer. Another object of this invention is the preparation of dispersions with a wide range of ratios of hydrophobic compound to polymer, from about 50:1 to 1:20, more preferably from about 10:1 to 1:10. Yet another object of this invention is to prepare photographic dispersions with superior stability toward crystallization of the loaded component. Another object is the preparation of photographic elements with superior attributes, comprising such dispersions. These improved attributes include color reproduction, natural aging properties, image preservability toward light, heat, and humidity, and resistance to scratching or delamination. Another object is the preparation of photographic elements comprising loaded latex dispersions of latex polymers which impart favorable photographic properties, but that fail "tests of latex loadability" described in the prior art. Other objects of this invention will be apparent in this disclosure and the examples described.

DETAILED DESCRIPTION OF THE INVENTION

In one embodiment of the invention, the liquid organic composition is formed by combining one or more hydrophobic photographically useful compounds with one or more high-boiling solvents at a temperature sufficient to prepare a homogeneous organic solution, and the organic solution is then mixed with an aqueous solution containing gelatin, surfactant, and the polymer latex. In another embodiment of the invention, the liquid organic composition is first combined with an aqueous solution containing gelatin and surfactant to form an aqueous dispersion of the liquid organic composition, and the resulting dispersion is then combined with another aqueous solution containing the polymer latex.

Photographic coating solutions containing gelatin are generally held above 35°–40° C. in order to avoid setting of the gelatin. If the temperature of such solutions is raised too high, however, excessive evaporation may occur, as well as other detrimental effects depending upon the composition of the solution (e.g., solutions containing silver halide emulsions may become fogged). Also, in multilayer coating operations, thermal uniformity of the multiple layers is an important coating parameter. Accordingly, such photographic coating solutions are generally held before coating at a relatively uniform temperature above the gel-set temperature, but below 60° C. It has been found that latex polymers having a glass transition temperature (Tg) above the hold temperature for gelatin containing dispersions, e.g. above 60° C. and especially above 90° C., generally require longer times to load than polymers having a Tg below such temperatures. Accordingly, where gelatin is also combined with the liquid organic composition and the polymer latex, and the polymer has a Tg of 60° C. or more or 90° C. or more, in a preferred embodiment of the invention the combination resulting from (a) is held for at least 1 hour, more preferably at least 2 hours and most preferably at least 3 hours, in a liquid state below 60° C. before coating on the support.

The factors that contribute to improved likelihood that latex loading will occur when a polymer latex is combined with a dispersion of a hydrophobic photographically useful compound or mixture and held for a given length of time in a liquid state include the following:

(1) Hydrophobic photographically useful compounds with low logP (less than about 9) are more likely to load rapidly compared to compounds with higher logP. LogP is defined as the logarithm of the value of the octanol/water partition coefficient (P) of the compound, a parameter highly correlated with measured water solubility for compounds spanning a wide range of hydrophobicity. The high partition coefficients of many photographically useful compounds are difficult to measure experimentally. It is also possible to estimate logP by using $\log P_{(calc)}$, a value calculated using MedChem 3.54, a software package available from the Medicinal Chemistry Project, Pomona College, Claremont, Calif.

(2) Polymers with lower glass transition temperatures ($T_g$) load more rapidly than polymers with high $T_g$. This effect is observable experimentally in some cases, and may relative to the rate of mass-transport of a hydrophobic molecule in the environment of the polymer. For a given hold temperature, polymers having a Tg below the hold temperature tend to be loaded must faster than polymers having a Tg above the hold temperature.

(3) The presence of surfactant promotes loading. This effect may be related to micellar transport of hydrophobicimolecules in the aqueous environment of the dispersion. Customary levels of surfactant used in forming oil-in-water dispersions of photographic compounds are generally sufficient to promote loading in accordance with the invention. Often, the same surfactant used for the emulsion polymerization may be sufficient for the preparation of the photographic elements and dispersions of the invention.

(4) Combinations of photographically useful compounds and polymers that are miscible with each other are a common feature of loaded dispersions. An important driving force for loading is the favorable mixing of polymer with the oil components of the dispersion, and combinations of polymers and dispersion oil components that are immiscible are less likely to form loaded latex dispersions under any given set of conditions. The presence of high-boiling solvents, (coupler solvents) can improve the solubility of photographically useful compounds in the polymer, and in this way can promote formation of loaded latex dispersions. Mixtures of photographically useful compounds can be employed in the absence of any high-boiling solvents, as can a single photographically useful compound. The examples in this disclosure describe some combinations of photographically useful compounds, latex polymers, and dispersion conditions that lead to formation of loaded latex dispersions according to the invention.

Any of several indications may be taken as evidence that a loaded latex dispersion has been formed. Direct evidence of phase mixing of the polymer latex and the photographically useful compound or compounds may be obtained by a number of measurement techniques, including Differential Scanning Calorimetry (DSC) and dielectric loss measurements. In general, loaded latex dispersions will show a single glass transition temperature ($T_g$) for the mixture, while unassociated polymer latex phases and photographic dispersed oil phases will exhibit separate $T_g$'s unaffected by their combination.

Another evidence of latex loading is the effect of the loading process on dispersion particle size. Often loaded latex dispersions will show a single distribution of particle size, usually smaller than the distribution of size seen in a conventional photographic dispersion. Unassociated polymer latex and photographic dispersion will maintain their individual particle size distributions when combined, manifested typically as a bimodal particle size distribution. One possible reason for many loaded latex dispersions showing smaller apparent particle size is that typical polymer latices have a monodisperse distribution of particle diameters, usually between 0.020 and 0.200 microns, while conventional milled photographic dispersions have a wider distribution of particle sizes centered between 0.05 and 0.4 micron, typically between 0.150 and 0.400 microns. In one proposed mechanism to explain latex loading, the dispersion particles composed of photographically useful compounds dissolve or disappear as loading occurs, so that in the final loaded latex dispersion, the combined mass of polymer and photographically useful compounds are distributed among a similar number of particles that comprised the initial polymer latex. Often this number is much larger than the initial number of dispersion particles comprising the oil solution of photographically useful compounds, so the average size of the loaded particles is smaller than that of the initial photographically useful compound dispersion particles. However, the loading process may occur with little change in apparent particle size or with an apparent increase in dispersion size, particularly if the oil:polymer ratio is large, or the initial latex particle size is large.

A contributing factor why loaded latex dispersion may often appear to be smaller than conventional dispersions is that many useful particle size measurement techniques do not accurately measure extremely broad or multimodal distributions of particle size. Many useful techniques are most sensitive to the larger particles in a broad distribution. Turbidity measurement can be very useful, and turbidity changes as latex loading occurs can be a very dramatic evidence for latex loading. Typically, the conventional photographic dispersion is much larger than the latex and is largely responsible for the light scattering in the sample immediately after mixing. As loading occurs, the decrease in scattering due to disappearance of the large conventional dispersion droplets dominates the measurement, and the increased scattering from the smaller latex particles as their size increases is less apparent. Another useful technique for measuring particle size is Photon Correlation Spectroscopy (PCS), a dynamic light scattering technique that derives particle sizes and distributions from particle motion in a medium, typically water for photographically useful dispersions. Again, because the measurement is based on light scattering, the small signal from a monodisperse small-diameter latex is often masked by the presence of a typical photographic dispersion that causes much more light scattering. In this case, as loading occurs, the measurement will often indicate a substantial decrease in particle size. Similarly, microscopic techniques, particularly optical microscopy, are well adapted for observing conventional photographic dispersions larger than about 0.250 microns, but are usually unable to resolve the much smaller latex particles. As loading occurs, the apparent particle size observed by optical microscopy often decreases, and the final loaded dispersion may be sufficiently small to be unresolvable by the technique, with the net observation that the initial dispersion particles have "disappeared."

Another evidence of formation of loaded latex dispersions of the invention is the effect of the dispersions on the photographic performance. It has been shown that polymer containing dispersions can affect the reactivity and hue of photographic couplers, the stability of the unprocessed photographic element, the stability of dispersions toward crystallization, and the stability of the final photographic image toward heat, light and humidity. Even in the absence of direct evidence, indirect evidence of loading can be derived from photographic performance, particularly where the effects are consistent with known performance of polymer-containing dispersions prepared by other means, including the emulsification of a mixed solution of polymer, photographically useful compound, and auxiliary solvent.

The process of the invention is generally applicable to forming loaded latex dispersions of photographically useful compounds that may be used at various locations throughout a photographic element.

Photographically useful compounds that can be loaded into polymer latices include photographic couplers, (including yellow, magenta and cyan image-forming couplers, colored or masking couplers, inhibitor-releasing couplers, and bleach accelerator-releasing couplers, dye-releasing couplers, etc.), UV absorbers, dyes, high-boiling organic solvents, reducing agents (including $D_{ox}$ scavengers and nucleators), stabilizers (including image stabilizers, stain-control agents, and developer scavengers), developing agents, optical brighteners, lubricants, etc.

Oil components of the dispersions of the invention preferably include couplers.

Image dye-forming couplers may be included in the element such as couplers that form cyan dyes upon reaction with oxidized color developing agents which are described in such representative patents and publications as: U.S. Pat. Nos. 2,772,162; 2,895,826; 3,002,836; 3,034,892; 2,474,293; 2,423,730; 2,367,531; 3,041,236; 4,883,746 and "Farbkuppler—Eine Literature Ubersicht," published inAgfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. In a preferred embodiment of the invention, an acetanilide yellow coupler is used which has the formula:

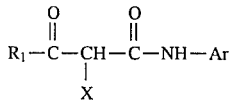

wherein $R_1$ is an alkyl, aryl, anilino, alkylamino or heterocyclic group; Ar is an aryl group; and X is hydrogen or a coupling-off group. The $R_1$, Ar and X groups may each contain further substituents as is well known in the art. $R_1$ is preferably:

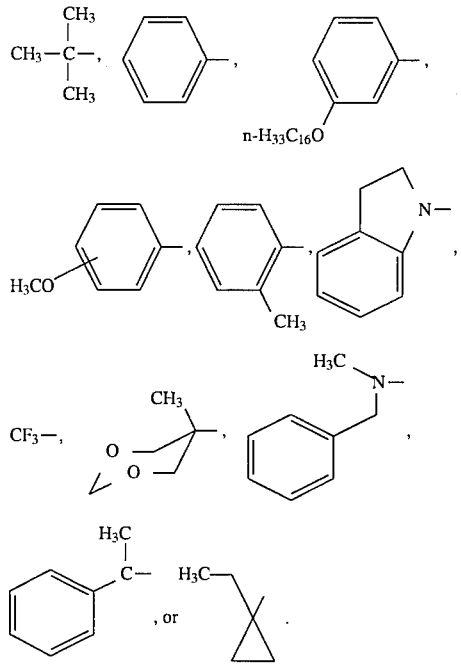

In particularly preferred embodiments of the invention a pivaloylacetanilide yellow coupler is used wherein $R_1$ is t-butyl.

Ar is preferably substituted phenyl wherein at least one substituent is halo, alkoxy or aryloxy. Ar preferably additionally contains a ballasting group. Ballasting groups usually comprise one or more 5 to 25 carbon atom containing organic moieties whose function is to immobilize the coupler and the formed image dye during photographic development by imparting poor water diffusibility to the coupler compound.

X is a hydrogen or a coupling-off group. Coupling-off groups are generally organic groups which are released during photographic processing. The released coupling-off group can be a photographically useful group.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

Generally the presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in U.K. Patents and published application Nos. 1,466,728; 1,531,927; 1,533,039; 2,006,755A; and 2,017,704A, the disclosures of which are incorporated herein by reference.

It may be useful to use a combination of couplers any of which may contain known ballasts or coupling-off groups such as those described in U.S. Pat. Nos. 4,301,235; 4,853,319 and 4,351,897. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. No. 2,983,608; German Application DE 2,706,117C; U.K. Patent 1,530,272; Japanese Application A-113935; U.S. Pat. Nos. 4,070,191 and 4,273,861; and German Application DE 2,643,965. The masking couplers may be shifted or blocked.

Typical couplers that can be used with the elements of this invention include those shown below.

C-1

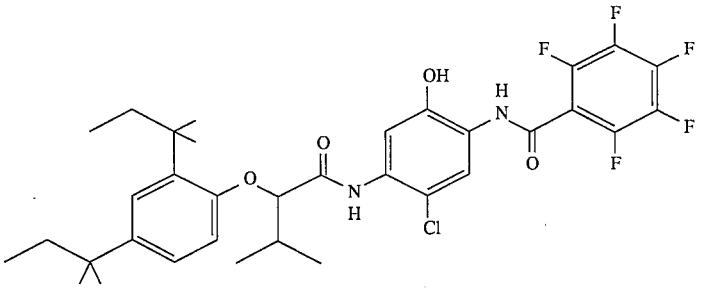

C-2

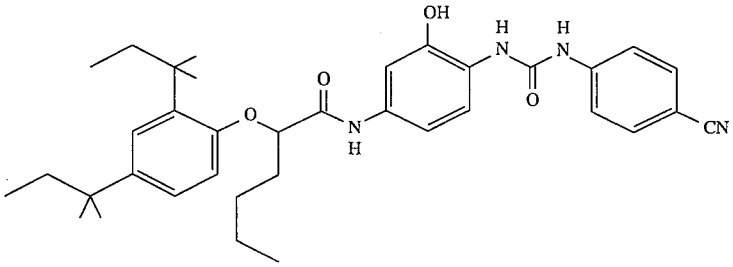

C-3

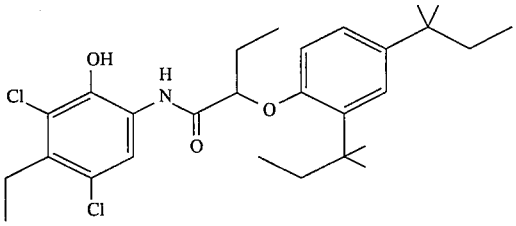

C-4

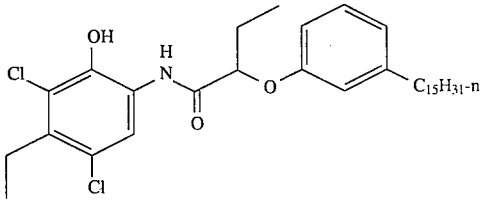

C-5

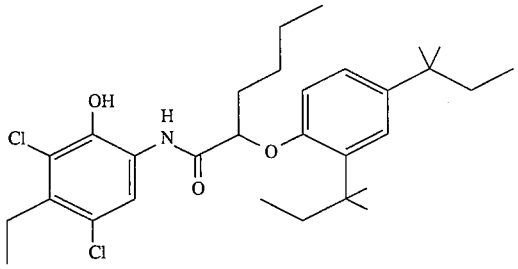

C-6

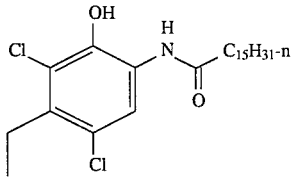

-continued
C-7
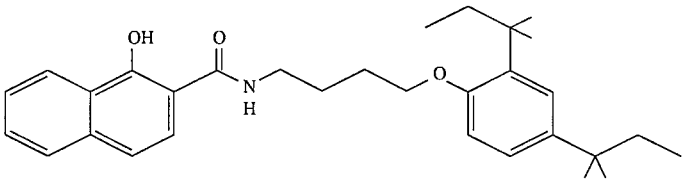
C-8
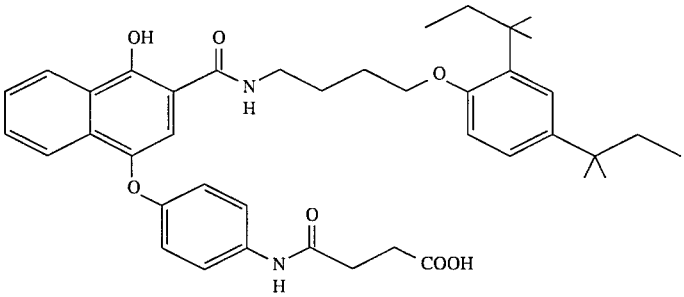
C-9
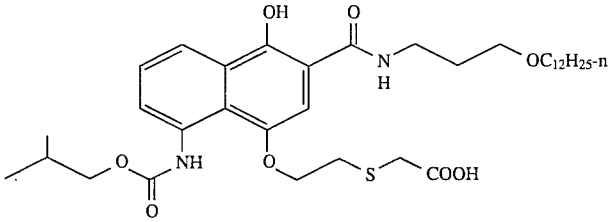
C-10
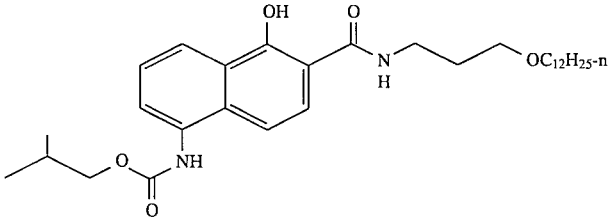
C-11
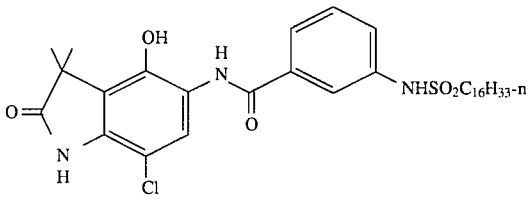
C-12
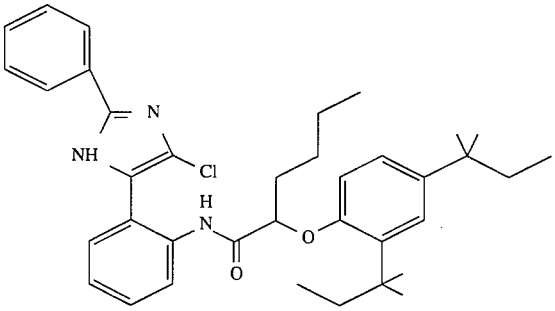
C-13
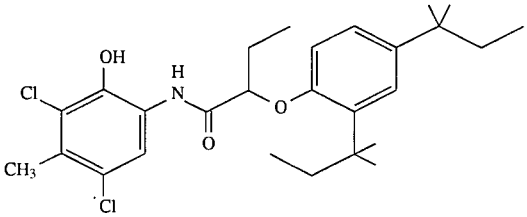

-continued
M-1
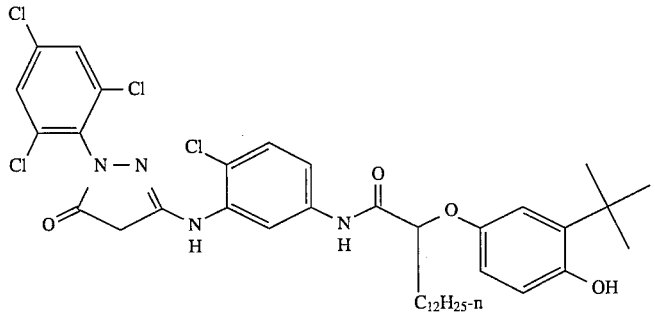
M-2
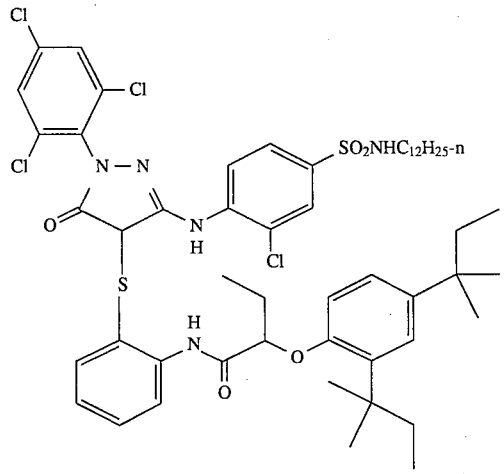
M-3
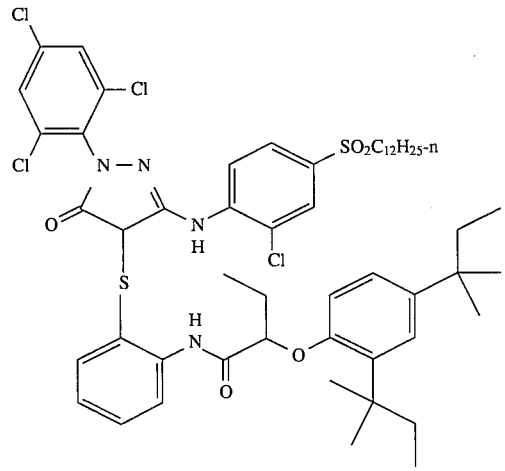
M-4
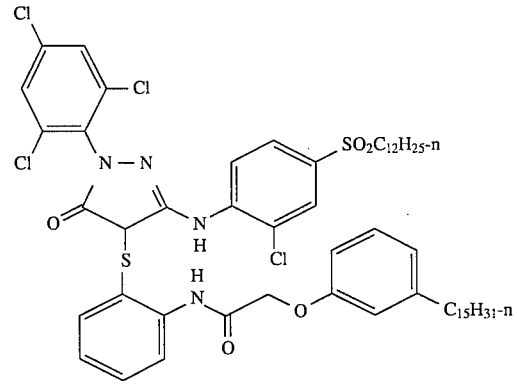

-continued
M-5
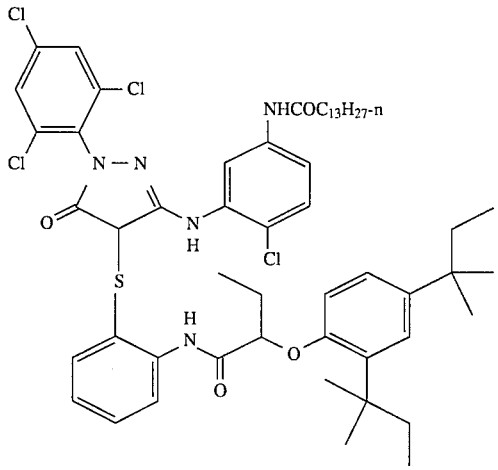
M-6
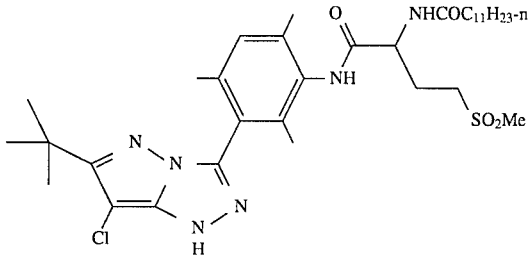
M-7
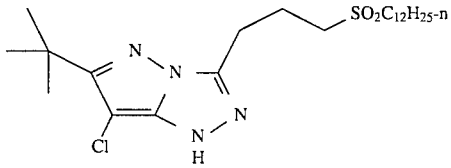
M-8
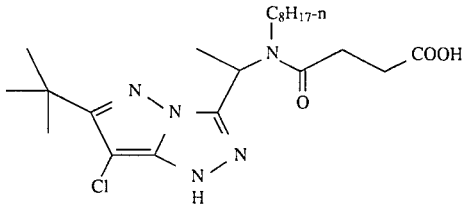
M-9
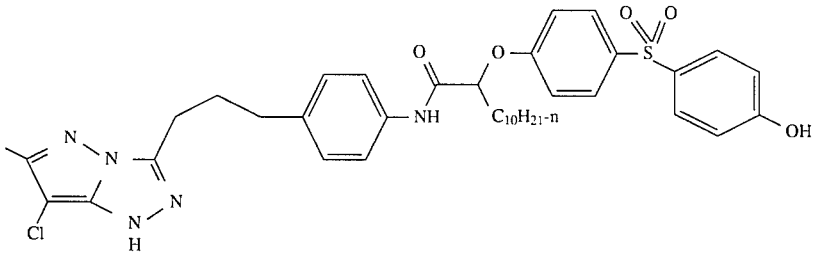

-continued
M-10
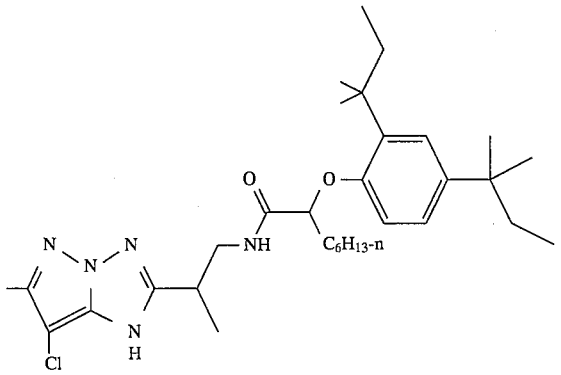
M-11
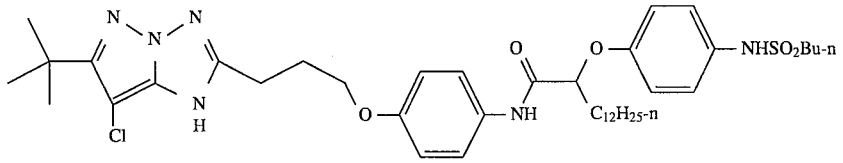
M-12
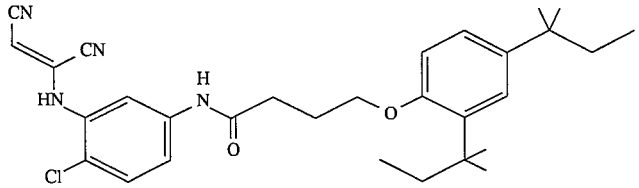
Y-1
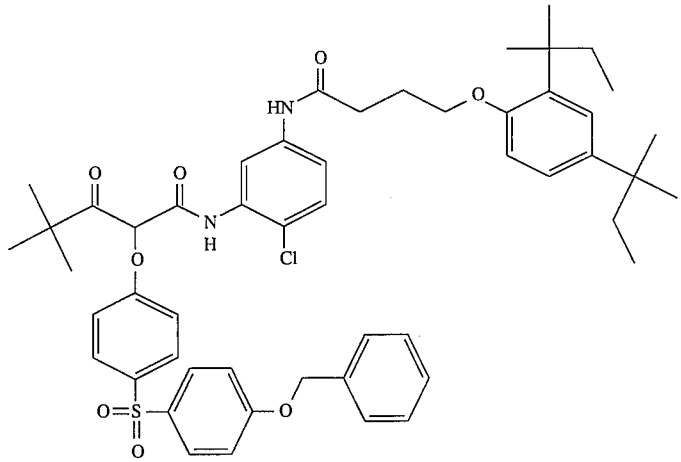
Y-2
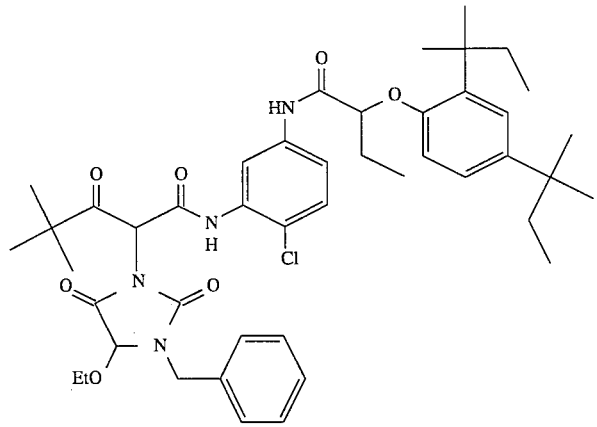

-continued
Y-3
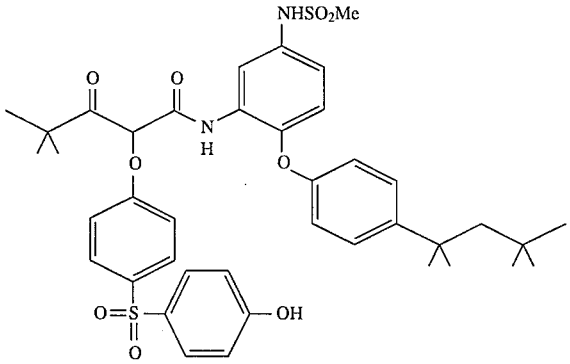
Y-4
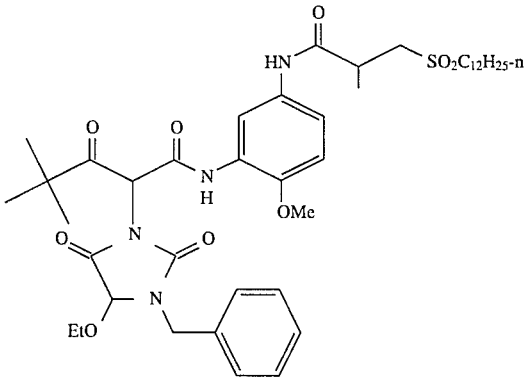
Y-5
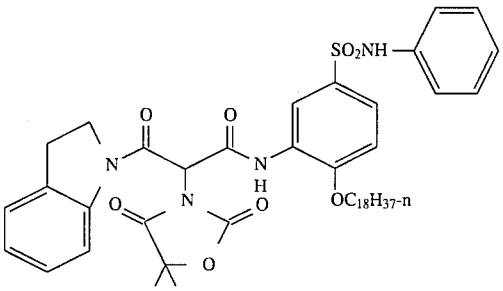
Y-6
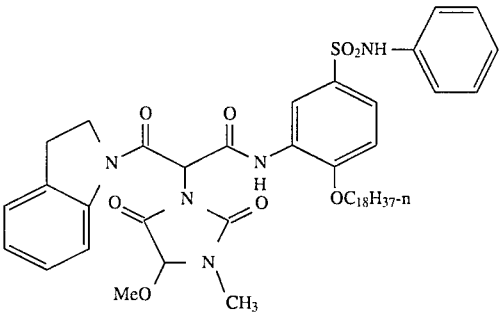
Y-7
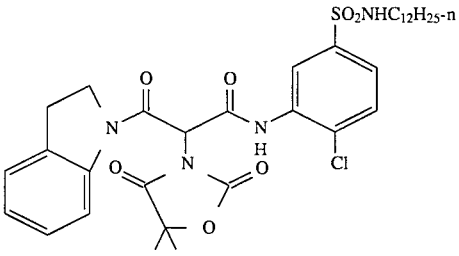

-continued
Y-8
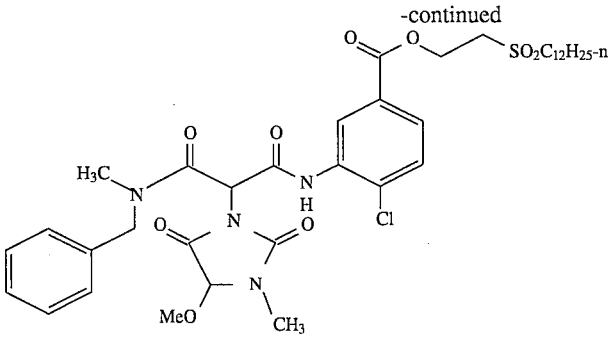
Y-9
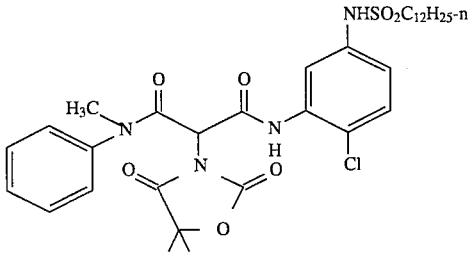
Y-10
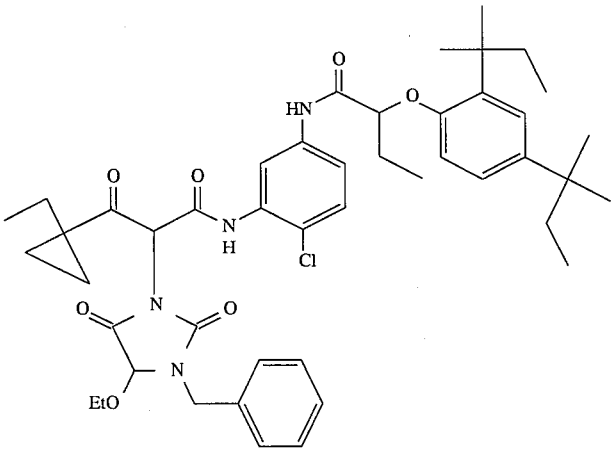
Y-11
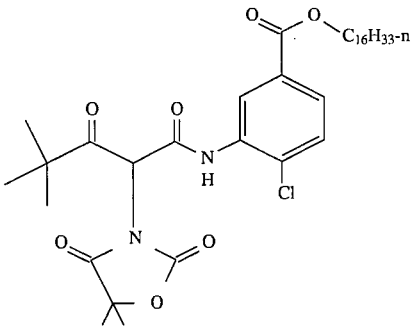
Y-12
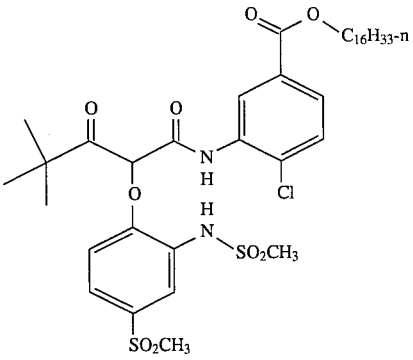

-continued
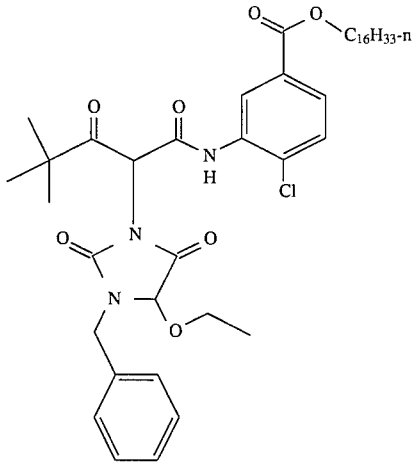
Y-13
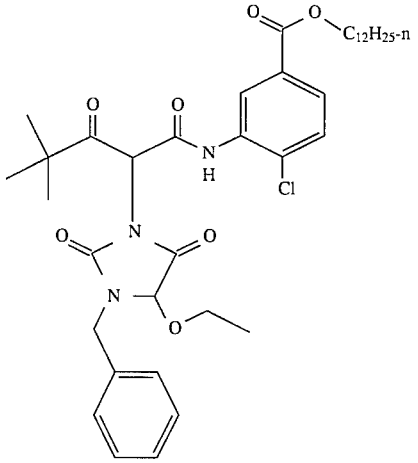
Y-14
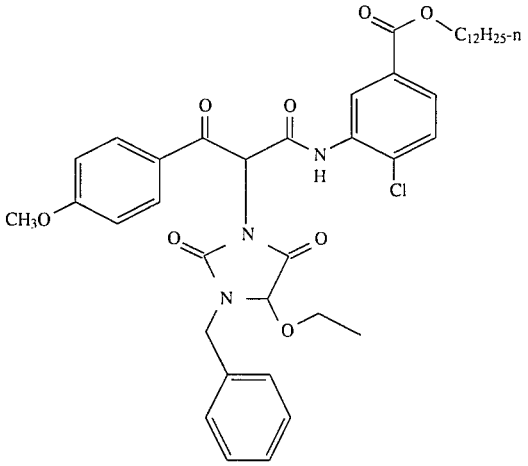
Y-15

-continued

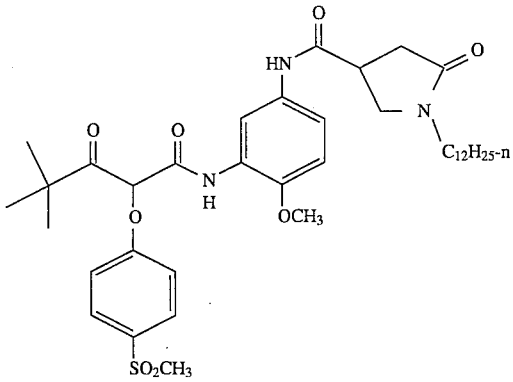

Y-16

The invention materials may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

Suitable hydroquinone color fog inhibitors include, but are not limited to compounds disclosed in EP 69,070; EP 98,241; EP 265,808; Japanese Published Patent Applications 61/233,744; 62/178,250; and 62/178,257. In addition, specifically contemplated are 1,4-benzenedipentanoic acid, 2,5-dihydroxy-delta,delta,delta',delta'-tetramethyl-, dihexyl ester; 1,4-Benzenedipentanoic acid, 2-hydroxy-5-methoxy-delta,delta,delta',delta'-tetramethyl-, dihexyl ester; and 2,5-dimethoxy-delta,delta,delta',delta'-tetramethyl-, dihexyl ester. In addition, it is contemplated that materials of this invention may be used with so called liquid ultraviolet absorbers such as described in U.S. Pat. Nos. 4,992,358; 4,975,360; and 4,587,346.

Various kinds of discoloration inhibitors can be used in conjunction with elements of this invention. Typical examples of organic discoloration inhibitors include hindered phenols represented by hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylation, alkylation or acylation of phenolic hydroxy groups of the above compounds. Also, metal complex salts represented by (bis-salicylaldoximato)nickel complex and (bis-N,N-dialkyldithiocarbamato)nickel complex can be employed as a discoloration inhibitor. Specific examples of the organic discoloration inhibitors are described below. For instance, those of hydroquinones are disclosed in U.S. Pat. Nos. 2,360,290; 2,418,613; 2,700,453; 2,701,197; 2,710,801; 2,816,028; 2,728,659; 2,732,300; 2,735,765; 3,982,944 and 4,430,425; and British Patent 1,363,921; and so on; 6-hydroxychromans, 5-hydroxycoumarans, spirochromans are disclosed in U.S. Pat. Nos. 3,432,300; 3,573,050; 3,574,627; 3,698,909 and 3,764,337; and Japanese Published Patent Application 52-152,225; and so on; spiroindanes are disclosed in U.S. Pat. No. 4,360,589; those of p-alkoxyphenols are disclosed in U.S. Pat. No. 2,735,765; British Patent 2,066,975; Japanese Published Patent Applications 59-010,539 and 57-019,765; and so on; hindered phenols are disclosed, for example, in U.S. Pat. Nos. 3,700,455; 4,228,235; Japanese Published Patent Applications 52-072,224 and 52-006,623; and so on; gallic acid derivatives, methylenedioxybenzenes and aminophenols are disclosed in U.S. Pat. Nos. 3,457,079; 4,332,886; and Japanese Published Patent Application 56-021,144, respectively; hindered amines are disclosed in U.S. Pat. Nos. 3,336,135; 4,268,593; British Patents 1,326,889; 1,354,313 and 1,410,846; Japanese Published Patent Applications 51-001,420; 58-114,036; 59-053,846; 59-078,344; and so on; those of ether or ester derivatives of phenolic hydroxy groups are disclosed in U.S. Pat. Nos. 4,155,765; 4,174,220; 4,254,216; 4,279,990; Japanese Published Patent Applications 54-145,530; 55-006,321; 58-105,147; 59-010,539; 57-037,856; 53-003,263 and so on; and those of metal complexes are disclosed in U.S. Pat. Nos. 4,050,938 and 4,241,155.

Stabilizers that can be used with the invention include but are not limited to the following.

ST-1

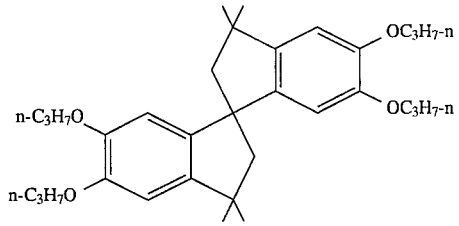

-continued
ST-2
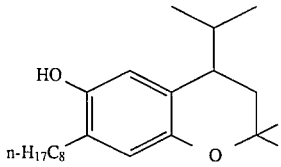
ST-3
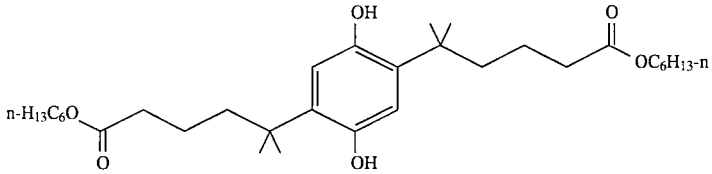
ST-4
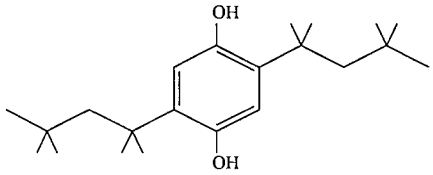
ST-5
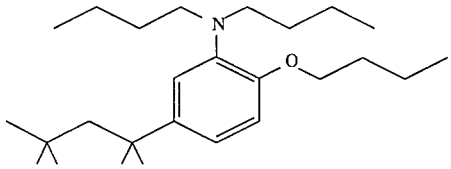
ST-6
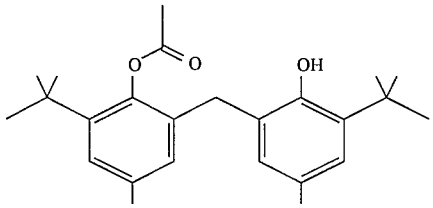
ST-7
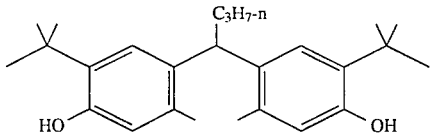
ST-8
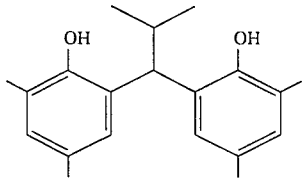
ST-9
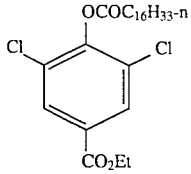
ST-10
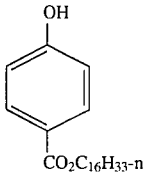

-continued
ST-11
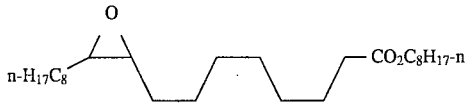
ST-12
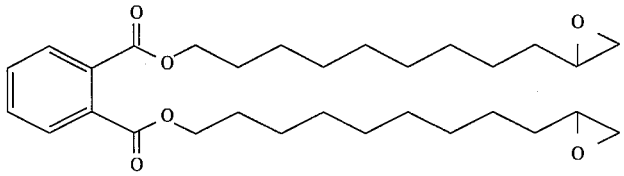
ST-13
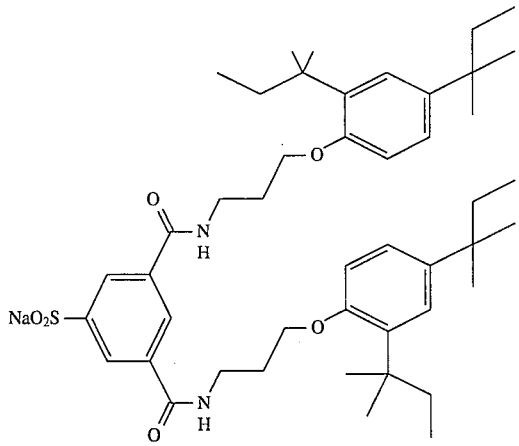
ST-14
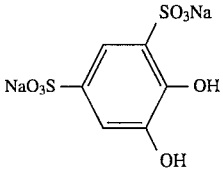
ST-15
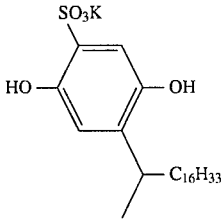
ST-16
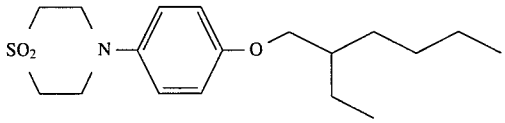
ST-17
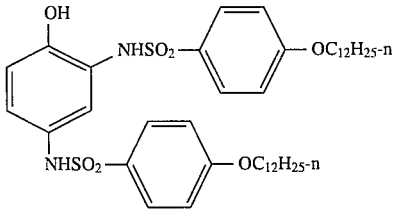

-continued

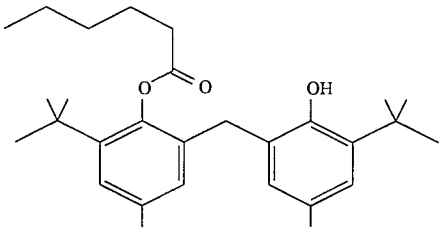

ST-18

In a preferred embodiment of the invention, a bisphenol stabilizer, such as ST-6, ST-7, ST-8, or ST-18, is combined with a yellow dye forming coupler in a loaded latex dispersion of the invention. Such combinations have been found to possess particularly advantageous light stability.

The liquid organic, or oil phase, components of the dispersions of the invention may also include high-boiling or permanent organic solvents. High boiling solvents have a boiling point sufficiently high, generally above 150° C. at atmospheric pressure, such that they are not evaporated under normal dispersion making and photographic layer coating procedures. Non-limitive examples of high boiling organic solvents that may be used include the following.

| | |
|---|---|
| S-1 | Dibutyl phthalate |
| S-2 | Tritolyl phosphate |
| S-3 | N,N-Diethyldodecanamide |
| S-4 | Tris(2-ethylhexyl)phosphate |
| S-5 | Octyl oleate monoepoxide |
| S-6 | 2,5-Di-t-pentylphenol |
| S-7 | Acetyl tributyl citrate |
| S-8 | 1,4-Cyclohexylenedimethylene bis(2-ethylhexanoate) |
| S-9 | Bis(2-ethylhexyl) phthalate |
| S-10 | 2-phenylethyl benzoate |
| S-11 | Dibutyl sebacate |
| S-12 | N,N-Dibutyldodecanamide |
| S-13 | Oleyl alcohol |
| S-14 | 2-(2-Butoxyethoxy)ethyl acetate |

The dispersions of the invention may also include UV stabilizers. Examples of UV stabilizers are shown below.

UV-1

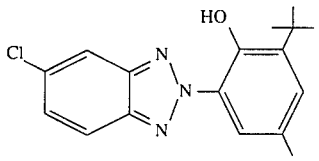

UV-2

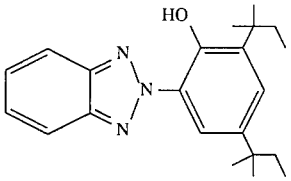

UV-3

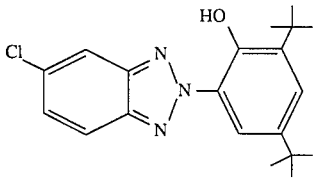

-continued

UV-4

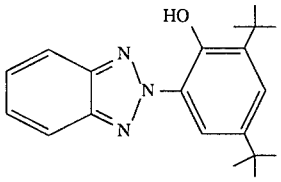

UV-5

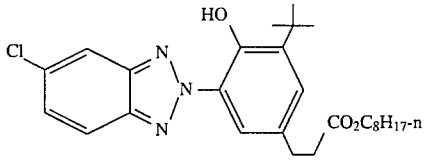

UV-6

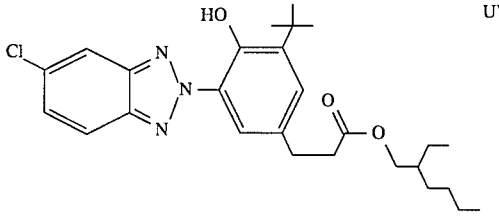

UV-7

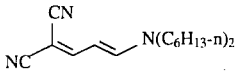

UV-8

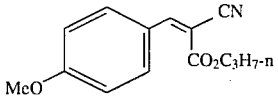

The aqueous phase of the dispersions of the invention may comprise a hydrophilic colloid, preferably gelatin. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. The hydrophilic colloid may be another water-soluble polymer or copolymer including, but not limited to poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The loaded latex dispersions of the invention include surfactants. Useful surfactants include those customarily used in forming latex dispersions by emulsion polymerization and those used in forming small particle oil-in-water photographic dispersions. Such surfactants may be cationic, anionic, zwitterionic or non-ionic. In a preferred embodiment of the invention, the loaded latex dispersions are formed in the presence of anionic and/or nonionic surfactants. Ratios of surfactant to liquid organic solution typically are in the range of 0.5 to 25 wt. % for forming small particle photographic dispersions, which ratios are also useful for the invention dispersions. Useful surfactants include, but are not limited the following.

F-1

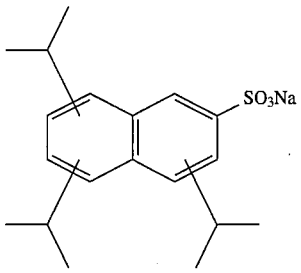

$CF_3^-(CF_2)_7^-SO_3Na$ F-2

$CH_3^-(CH_2)_n^-SO_3Na$ n = 12–14 F-3

F-4

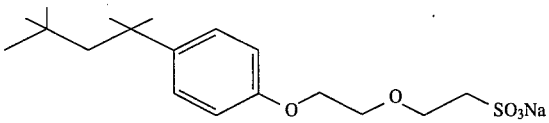

$CH_3^-(CH_2)_{11}^-OSO_3Na$ F-5

F-6

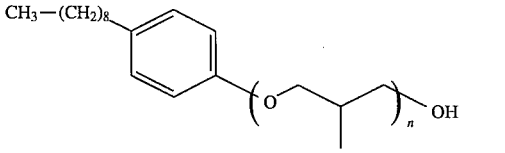

n = ca. 10

F-7

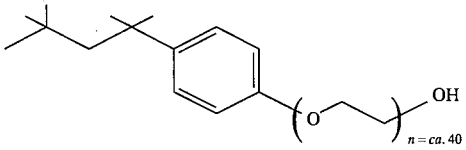

F-8

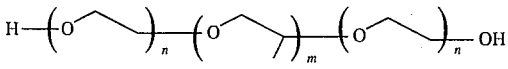

n = ca. 6
m = ca. 22

F-9

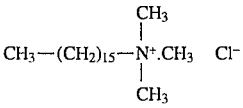

F-10

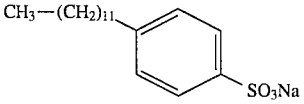

F-11

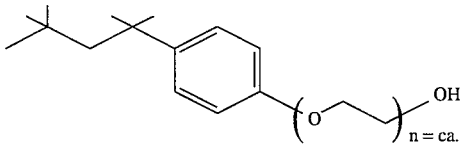

For the purposes of this invention, "high shear or turbulent" conditions defines shear and turbulence conditions sufficient to generate a small particle conventional photographic dispersion of a coupler with a coupler solvent, such as the formulation of Dispersion 301 of Example 3 below, with an average particle size of less than about 0.4 micron, while "low or moderate shear" mixing defines shear and turbulence conditions insufficient to generate such small particle dispersions for such formulations.

Devices suitable for low or moderate shear mixing of the dispersions of the invention include standard mixing equipment used in the art to maintain overall thermal and chemical uniformity of a vessel of liquid material, including stirrers, propellers, circulating pumps, and moderate-shear blade mixers. Devices suitable for the high-shear or turbulent mixing of small-particle conventional dispersions that are subsequently combined with polymer latex to form dispersions of the invention include those generally suitable for preparing submicron photographic emulsified dispersions. These include but are not limited to blade mixers, rotor-stator mixers, devices in which a liquid stream is pumped at high pressure through an orifice or interaction chamber, sonication, Gaulin mills, homogenizers, blenders, etc. More than one type of device may be used to prepare the dispersions.

Preferred latex polymers of the invention include addition polymers prepared by emulsion polymerization. Especially preferred are polymers prepared as latex with essentially no water-miscible or volatile solvent added to the monomer. Also suitable are dispersed addition or condensation polymers, prepared by emulsification of a polymer solution, or self-dispersing polymers.

Especially preferred latex polymers include those prepared by free-radical polymerization of vinyl monomers in aqueous emulsion. Polymers comprising monomers that form water-insoluble homopolymers are preferred, as are copolymers of such monomers, which may also comprise monomers which give water-soluble homopolymers, if the overall polymer composition is sufficiently water-insoluble to form a latex.

Examples of suitable monomers include allyl compounds such as allyl esters (e.g., allyl acetate, allyl caproate, etc.); vinyl ethers (e.g., methyl vinyl ether, butyl vinyl ether, methoxyethyl vinyl ether, ethoxyethyl vinyl ether, chloroethyl vinyl ether, 1-methyl- 2,2-dimethylpropyl vinyl ether, hydroxyethyl vinyl ether, diethylene glycol vinyl ether, dimethylaminoethyl vinyl ether, butylaminoethyl vinyl ether, benzyl vinyl ether, tetrahydrofurfuryl vinyl ether, etc.); vinyl esters (such as vinyl acetate, methacrylate, sodium-2-sulfoethyl acrylate, 2-aminoethylmethacrylate hydrochloride, glycidyl methacrylate, ethylene glycol dimethacrylate, etc.); and acrylamides and methacrylamides (such as acrylamide, methacrylamide, N-methylacrylamide, N,N-dimethylacrylamide, N-isopropylacrylamide, N-s-butylacrylamide, N-t-butylacrylamide, N-cyclohexylacrylamide, N-(3-aminopropyl)methacrylamide hydrochloride, N-(3-dimethylaminopropyl)methacrylamide hydrochloride, N,N-dipropylacrylamide, N-(1,1-dimethyl- 3-oxobutyl)acrylamide, N-(1,1,2-trimethylpropyl)acrylamide, N-(1,1,3,3-tetramethylbutyl)acrylamide, N-(1-phthalamidomethyl)acrylamide, sodium N-(1,1-dimethyl-2-sulfoethyl)acrylamide, N-butylacrylamide, N-(1,1-dimethyl-3-oxobutyl)acrylamide, N-(2-carboxyethyl)acrylamide, 3-acrylamido-3-methylbutanoic acid, methylene bisacrylamide, etc.).

In a preferred embodiment of the invention, the latex polymer comprises at least about 50% N-alkylacrylamide monomer units, where the alkyl substituent preferably has from 3–8 carbon atoms, such as N-tert-butylacrylamide units, which impart particularly desirable photographic performance in the elements of the invention. Polymers of similarly high glass transition temperature (Tg), e.g., higher than 60° C. and more preferably higher than 90° C., are also particularly preferred.

Latex polymers generally comprise polymer particles having an average particle diameter of from about 0.02 to 2.0 microns. In a preferred embodiment of the invention, latex particles having an average diameter of from about 0.03 to 0.5 microns are used in the dispersions of the invention. In a more preferred vinyl propionate, vinyl butyrate, vinyl isobutyrate, vinyl dimethyl propionate, vinyl ethyl butyrate, vinyl chloroacetate, vinyl dichloroacetate, vinyl methoxyacetate, vinyl phenyl acetate, vinyl acetoacetate, etc.); vinyl heterocyclic compounds (such as N-vinyl oxazolidone, N-vinylimidazole, N-vinylpyrrolidone, N-vinylcarbazole, vinyl thiophene, N-vinylethyl acetamide, etc.); styrenes (e.g., styrene, divinylbenzene, methylstyrene, dimethylstyrene, ethylstyrene, isopropylstyrene, sodium styrenesulfonate, potassium styrenesulfinate, butylstyrene, hexylstyrene, cyclohexylstyrene, benzylstyrene, chloromethylstyrene, trifluoromethylstyrene, acetoxymethylstyrene, acetoxystyrene, vinylphenol, (t-butoxycarbonyloxy) styrene, methoxystyrene, 4-methoxy-3-methylstyrene, dimethoxystyrene, chlorostyrene, dichlorostyrene, trichlorostyrene, bromostyrene, iodostyrene, fluorostyrene, methyl vinylbenzoate ester, vinylbenzoic acid, etc.); crotonic acids (such as crotonic acid, crotonic acid amide, crotonate esters (e.g., butyl crotonate, etc.)); vinyl ketones (e.g., methyl vinyl ketone, etc ); olefins (e.g., dicyclopentadiene, ethylene, propylene, 1-butene, 5,5-dimethyl-1-octene, etc.); itaconic acids and esters (e.g., itaconic acid, methyl itaconate, etc.), other acids such as sorbic acid, cinnamic acid, methyl sorbate, citraconic acid, chloroacrylic acid mesaconic acid, maleic acid, fumaric acid, and ethacrylic acid; halogenated olefins (e.g., vinyl chloride, vinylidene chloride, etc.); unsaturated nitriles (e.g., acrylonitrile, etc.); acrylic or methacrylic acids and esters (such as acrylic acid, methyl acrylate, methacrylic acid, methyl methacrylate, ethyl acrylate, butyl acrylate, butyl methacrylate, 2-hydroxyethyl methacrylate, 2-acetoacetoxyethyl embodiment, latex particles having an average diameter of from about 0.03 to 0.2 microns are used.

The latex polymer average molecular weight generally ranges from about 1000 to 5,000,000 in non-crosslinked form. In a preferred embodiment of the invention, loaded latex dispersions of latex particles having an average molecular weight of from about 300,000 to 5,000,000 are formed. Dispersions with polymers having high molecular weight such as these are not easily formed by prior processes wherein a solution containing the polymer is emulsified and dispersed. In accordance with a further embodiment of the invention, where the latex polymers comprise crosslinked polymers, their molecular weight may far exceed 5,000,000.

Specific examples of useful polymer latex materials are given below. Copolymer ratios indicated are weight ratios unless otherwise specified.

| | |
|---|---|
| P-1 | Poly(N-tert-butylacrylamide) Tg ~146° C. |
| P-2 | Poly(N-cyclohexylamide) |
| P-3 | Poly(N-sec-butylacrylamide) |
| P-4 | Poly(N-(1,1,3,3-tetramethylbutyl)acrylamide) |
| P-5 | Poly(N-(1,1,2-trimethylpropyl)acrylamide) |
| P-6 | Poly(N-(1,1-dimethyl-3-oxobutyl)acrylamide) |
| P-7 | Poly(N-(1-phthalimidomethyl)acrylamide) |
| P-8 | Poly(N,N-di-n-propylacrylamide) |
| P-9 | N-tert-butylacrylamide/2-hydroxyethylmethacrylate copolymer (80/20) |
| P-10 | N-tert-butylacrylamide/methylene bisacrylamide copolymer (98/2) |
| P-11 | N-cyclohexylacrylamide/methylene bisacrylamide copolymer (98/2) |
| P-12 | 1,1-dimethyl-3-oxobutyl)acrylamide/methylene bisacrylamide copolymer (98/2) |
| P-13 | Methyl acrylate/2-acrylamido-2-methylpropane sulfonic acid copolymer (96/4) |
| P-14 | Methyl acrylate/2-acrylamido-2-methylpropane sulfonic acid copolymer (98/2) |
| P-15 | Methyl acrylate/2-acrylamido-2-methylpropane sulfonic acid/2-acetoacetoxyethyl methacrylate copolymer (91/5/4) Tg ~24° C. |

-continued

| | |
|---|---|
| P-16 | Methyl acrylate/2-acrylamido-2-methylpropane sulfonic acid/ethylene glycol dimethacrylate copolymer (96/2/2) |
| P-17 | Butyl acrylate/2-acrylamido-2-methylpropane sulfonic acid sodium salt/2-acetoacetoxyethyl methacrylate copolymer (90/6/4) Tg ~-42° C. |
| P-18 | Butyl acrylate/2-acrylamido-2-methylpropane sulfonic acid/ethylene glycol dimethacrylate copolymer (90/6/4) |
| P-19 | Butyl acrylate/styrene/methacrylamide/2-acrylamido-2-methylpropane sulfonic acid sodium salt copolymer (55/29/11/5) |
| P-20 | Butyl acrylate/styrene/2-acrylamido-2-methylpropane sulfonic acid sodium salt copolymer (85/10/5 |
| P-21 | Poly(butyl acrylate) |
| P-22 | Poly(hexyl acrylate) |
| P-23 | Poly(butyl methacrylate) |
| P-24 | Poly(hexyl methacrylate) |
| P-25 | Poly(vinylidene chloride) |
| P-26 | Poly(vinyl chloride) |
| P-27 | Styrene/vinyl acetate copolymer (1/1 molar) |
| P-28 | Styrene/methyl vinyl ether copolymer (1/1 molar) |
| P-29 | Ethylene/vinyl acetate copolymer (1/1 molar) |
| P-30 | Poly(glycidyl methacrylate) |
| P-31 | Poly(methyl methacrylate) Tg ~110° C. |
| P-32 | Glycidyl methacrylate/ethylene glycol dimethacrylate copolymer (95/5) |
| P-33 | Poly(acrylonitrile) |
| P-34 | Acrylonitrile/vinylidene chloride/acrylic acid copolymer (15/79/6) |
| P-35 | Styrene/butyl methacrylate/2-sulfoethyl methacrylate sodium salt copolymer (30/60/10) |
| P-36 | Polystyrene |
| P-37 | Poly(4-acetoxystyrene) |
| P-38 | Poly(4-vinylphenol) |
| P-39 | Poly(4-t-butoxycarbonyloxystyrene) |
| P-40 | 2-(2'-Hydroxy-5'-methacrylyloxyethylphenyl)-2H-benzotriazole/ethyl acrylate/2-acrylamido-2-methylpropane sulfonic acid sodium salt copolymer (74/23/3) |
| P-41 | N-tert-butylacrylamide/3-acrylamido-3-methylbutanoic acid copolymer (99.5/0.5) |
| P-42 | N-tert-butylacrylamide/3-acrylamido-3-methylbutanoic acid copolymer (99.0/1.0) |
| P-43 | N-tert-butylacrylamide/3-acrylamido-3-methylbutanoic acid copolymer (98/2) |
| P-44 | N-tert-butylacrylamide/3-acrylamido-3-methylbutanoic acid copolymer (96/4) |
| P-45 | N-tert-butylacrylamide/3-acrylamido-3-methylbutanoic acid copolymer (92/8) |
| P-46 | N-tert-butylacrylamide/methyl acrylate copolymer (25/75) |
| P-47 | N-tert-butylacrylamide/methyl acrylate copolymer (50/50) |
| P-48 | N-tert-butylacrylamide/methyl acrylate copolymer (75/25) |
| P-49 | Poly(methyl acrylate) |
| P-50 | Methyl methacrylate/methyl acrylate copolymer (75/25) |
| P-51 | Methyl methacrylate/methyl acrylate copolymer (50/50) |
| P-52 | Methyl methacrylate/methyl acrylate copolymer (25/75) |
| P-53 | N-tert-butylacrylamide/2-acrylamido-2-methylpropane sulfonic acid sodium salt copolymer (98/2) |
| P-54 | N-tert-butylacrylamide/2-acrylamido-2-methylpropane sulfonic acid sodium salt copolymer (99/1) |
| P-55 | Methyl methacrylate/2-acrylamido-2-methylpropane sulfonic acid sodium salt copolymer (98/2) |

Suitable free-radical initiators for the polymerization include, but are not limited to the following compounds and classes. Inorganic salts suitable as initiators include potassium persulfate, sodium persulfate, potassium persulfate with sodium sulfite, etc. Peroxy compounds that may be used include benzoyl peroxide, t-butyl hydroperoxide, cumyl hydroperoxide, etc. Azo compounds that may be used include azobis(cyanovaleric acid), azobis(isobutyronitrile), 2,2'-azobis(2-amidinopropane) dihydrochloride, etc.

The latex polymers may additionally comprise photographically useful groups covalently bonded thereto, such as groups which function as photographic couplers, (including yellow, magenta and cyan image-forming couplers, colored or masking couplers, inhibitor-releasing couplers, and bleach accelerator-releasing couplers, dye-releasing couplers, etc.), UV absorbers, dyes, reducing agents (including oxidized developer scavengers and nucleators), stabilizers (including image stabilizers, stain-control agents, and developer scavengers), developing agents, optical brighteners, lubricants, etc.

The process of the invention is generally applicable to a wide range of latex polymer to loaded liquid organic solution weight ratios. Preferred loading ratios are from about 50:1 to 1:20, more preferred ratios being from about 10:1 to 1:10. Advantaged photographic performance is often seen with ratios from 1:1 to 1:5, particularly for loaded latex dispersions of image forming couplers. These higher ratios of liquid organic solution to polymer are not often readily prepared by prior latex loading procedures.

The photographic elements comprising the dispersions of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. In a preferred embodiment, the loaded latex dispersions of the invention are used in a photographic element that may be displayed for extended periods under illuminated conditions, such as a color paper photographic element which comprises photographic layers coated on a reflective support.

If desired, the photographic element can be used in conjunction with an applied magnetic layer as described in *Research Disclosure*, November 1992, Item 34390 published by Kenneth Mason Publications, Ltd., Dudley House, 12 North Street, Emsworth, Hampshire P010 7DQ, ENGLAND.

In the following discussion of suitable materials for use in the emulsions and elements that can be used in conjunction with this photographic element, reference will be made to *Research Disclosure*, September 1994, Item 36544, available as described above, which will be identified hereafter by the term "Research Disclosure." The contents of the *Research Disclosure*, including the patents and publications referenced therein, are incorporated herein by reference, and the Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described , for example, in Sections VI–IX. Layers and layer arrangements, color negative and color positive features, scan facilitating features, supports, exposure and processing can be found in Sections XI–XX.

It is also contemplated that the materials and processes described in an article titled "Typical and Preferred Color Paper, Color Negative, and Color Reversal Photographic Elements and Processing," published in *Research Disclosure*, February 1995, Volume 370 may also be advantageously used with elements of the invention.

Various types of hardeners are useful in conjunction with elements of the invention. In particular, bis(vinylsulfonyl) methane, bis(vinylsulfonyl) methyl ether, 1,2-bis(vinylsulfonyl-acetamido) ethane, 2,4-dichloro-6-hydroxy-s-triazine, triacryloyltriazine, and pyridinium, 1-(4-morpholinylcarbonyl)- 4-(2-sulfoethyl)-, inner salt are particularly useful. Also useful are so-called fast acting hardeners as disclosed in U.S. Pat. Nos. 4,418,142; 4,618,573; 4,673,632; 4,863,841; 4,877,724; 5,009,990; 5,236,822.

In a color negative element, it is contemplated to use the invention in conjunction with a photographic element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3- ((2-(4-ethoxy-2,5-dioxo-3-(phenylmethyl)-1-imidazolidinyl)- 3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis( 1,1-dimethylpropyl)phenoxy]acetyl]amino]-5-[( 2,2,3,3,4,4,4-heptafluoro-1-oxobutyl)amino]-4-hydroxyphenoxy]- 2,3-dihydroxy-6-[(propylamino)carbonyl]phenyl]thio]-1,3,4-thiadiazol-2-yl]thio]-, methyl ester and "Coupler 3": 1-((dodecyloxy)carbonyl) ethyl(3-chloro-4-((3-(2-chloro- 4-((1-tridecanoylethoxy)carbonyl)anilino)-3-oxo-2-(( 4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis (1,1-dimethylpropyl)phenoxy)-1-oxobutyl)amino)-N-(4,5-dihydro-5-oxo-1-(2,4,6-trichlorophenyl)-1H-pyrazol- 3-yl)-, "Coupler 5": Benzamide, 3-((2-(2,4-bis- (1,1-dimethylpropyl)phenoxy)-1-oxobutyl)amino)-N- (4', 5'-dihydro-5'-oxo-1'-(2,4,6-trichlorophenyl)(1,4'-bi- 1H-pyrazol)-3'-yl)-, "Coupler 6": Carbamic acid, (6 (((3-(dodecyloxy)propyl)amino)carbonyl)-5-hydroxy-1-naphthalenyl)-, 2-methylpropyl ester, "Coupler 7": Acetic acid, ((2-((3-(((3-(dodecyloxy)propyl)amino)carbonyl)- 4-hydroxy-8-(((2-methylpropoxy)carbonyl)amino)-1-naphthalenyl)oxy)ethyl)thio)-, and "Coupler 8": Benzamide, 3-((2-(2,4-bis(1,1-dimethylpropyl)phenoxy)- 1-oxobutyl)amino)-N-(4,5-dihydro-4-((4-methoxyphenyl)azo)- 5-oxo-1-(2,4,6-trichlorophenyl)-1H-pyrazol- 3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)- 4,5-dihydro-5-oxo-1H-pyrazol-3-yl ]-2-methyl- 2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-( 2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1 -dimethylpropyl)phenoxy) propyl)amino)carbonyl)-4-hydroxy-1-naphthalenyl)oxy)ethoxy)phenyl)azo)-4-hydroxy-, disodium salt; and a slow cyan layer containing Couplers 2 and 6;

(7) an undercoat layer containing Coupler 8; and (8) an antihalation layer.

Other color negative formats may employ the dispersions of the invention. Of particular interest are layer-thinned color negative film structures in which a smaller amount of gelatin is included in the coated layers.

In a reversal format, it is contemplated to use the invention in conjunction with an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-( 1-(((2-chloro-5-((dodecylsulfonyl)amino)phenyl)amino)carbonyl)- 3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)- 4,5-dihydro-5-oxo-1H-pyrazol-3-yl]-2-methyl-2-propenamide; "Coupler 4": Benzamide, 3-((2-(2,4-bis( 1,1-dimethylpropyl)phenoxy)-1-oxobutyl)amino)-N-( 4,5-dihydro-5-oxo-1-(2,4,6-trichlorophenyl)-1H-pyrazol-3-yl)-; and "Coupler 5": Benzamide, 3-(((2,4-bis( 1,1-dimethylpropyl)phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5', 6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-( 4-((2,2,3,3,4,4,4-heptafluoro-1-oxobutyl)amino- 3-hydroxyphenyl)-; a mid cyan containing "Coupler 7": Butanamide, N-(4-((2-(2,4-bis( 1,1-dimethylpropyl)phenoxy)-1-oxobutyl)amino)-2-hydroxyphenyl)- 2,2,3,3,4,4,4-heptafluoro- and "Coupler 8": Hexanamide, 2-(2,4-bis(1,1-dimethylpropyl)phenoxy)-N-( 4-((2,2,3,3,4,4,4-heptafluoro-1-oxobutyl)amino)-3-hydroxyphenyl)-;

(10) one or more interlayers possibly including fine-grained nonsensitized silver halide; and

(11) an antihalation layer.

The invention may also be used in conjunction with the photograpic elements described in sections XVII–XIX and XXI of an article titled "Typical and Preferred Color Paper, Color Negative, and Color Reversal Photographic Elements and Processing," published in *Research Disclosure*, February 1995, Volume 370.

The invention may also be used in combination with photographic elements containing filter dye layers comprising colloidal silver sol or yellow, cyan, and/or magenta filter dyes, either as oil-in-water dispersions, latex dispersions or as solid particle dispersions. Additionally, they may be used with elements containing "smearing" couplers (e.g. as described in U.S. Pat. No. 4,366,237; EP 96,570; U.S. Pat. Nos. 4,420,556 and 4,543,323.) Also, the compositions may be blocked or coated in protected form as described, for example, in Japanese Application 61/258,249 or U.S. Pat. No. 5,019,492.

The invention materials may further be used in combination with a photographic element containing image-modifying compounds such as "Developer InhibitorReleasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 35,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396; Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035;. 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. Nos. 4,438,193 and 4,618,571) and groups that combine the features describe above. It is typical that the timing group or moiety is of one of the formulas:

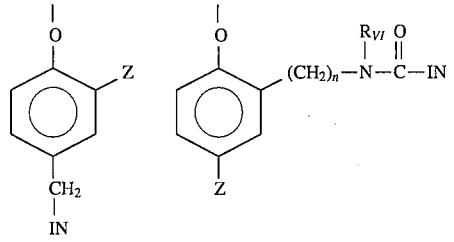

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

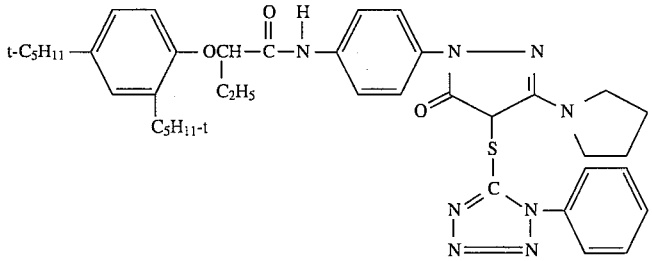

D2

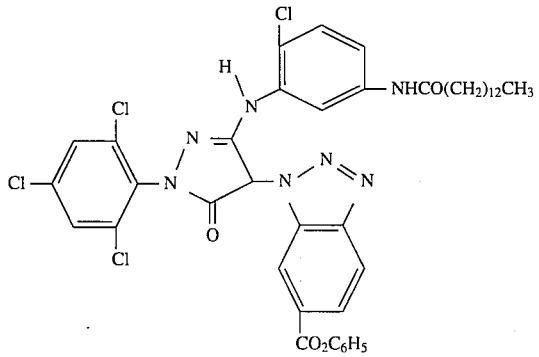

D3

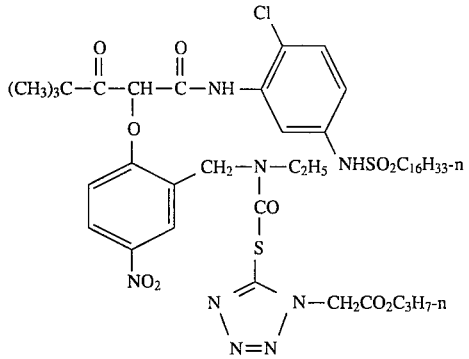

-continued
D4
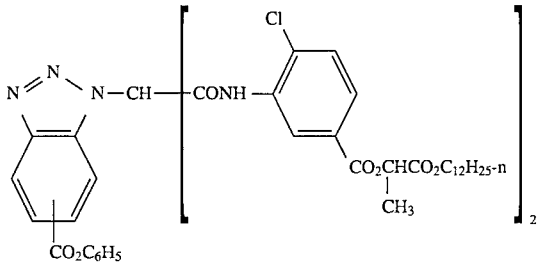
D5
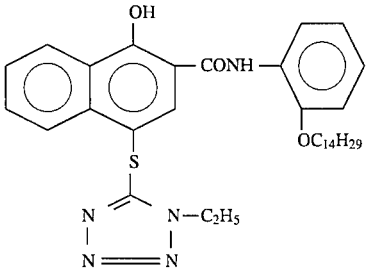
D6
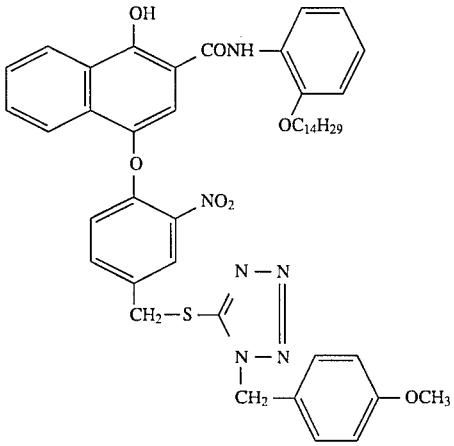
D7
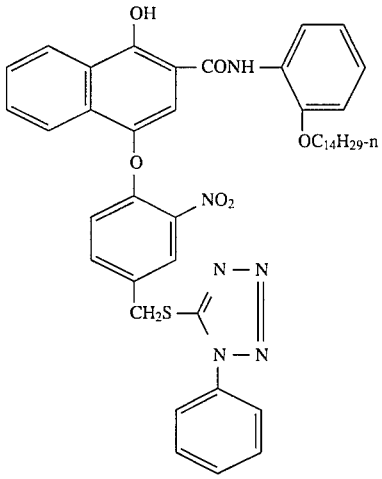

-continued

D8

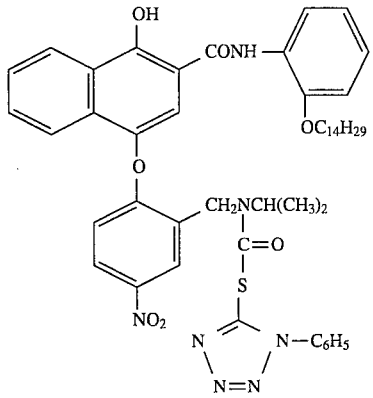

D9

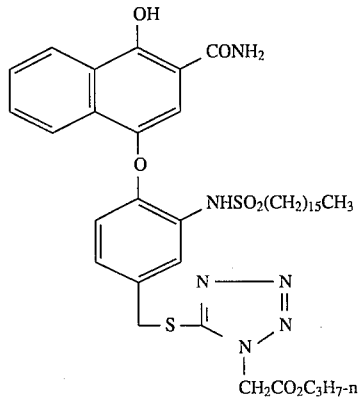

It is also contemplated that the concepts of the present invention may be employed to obtain reflection color prints as described in *Research Disclosure*, November 1979, Item 18716, incorporated herein by reference. Materials of the invention may be used in combination with a photographic element coated on pH adjusted support as described in U.S. Pat. No. 4,917,994; with a photographic element coated on support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171.

Especially useful for use with this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322;

4,914,014; 4,962,015; 4,985,350; 5,061,069; and 5,061,616. In addition, use of [100] tabular grain silver chloride emulsions as described in U.S. Pat. No. 5,320,938 are specifically contemplated.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Due to a desire for rapid development, preferred emulsions for color paper are high in silver chloride. Typically, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum.

Color paper elements typically contain less than 0.80 $g/m^2$ of total silver. Due to the need to decrease the environmental impact of color paper processing, it is desired to decrease the amount of total silver used in the element as much as possible. Therefore, total silver levels of less than 0.65 $g/m^2$ are preferable, and levels of 0.55 $g/m^2$ are even more preferable. It is possible to reduce further the total silver used in the color paper photographic element to less than 0.10 $g/m^2$ by use of a so-called development amplication process whereby the incorporated silver is used only to form the latent image, while another oxidant, such as hydrogen peroxide, serves as the primary oxidant to react with the color developer. Such processes are well-known to the art, and are described in, for example, U.S. Pat. No. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Pat. Nos. 5,316,904; 5,292,634; 5,354,651; and EP Patent Application 93/203193.3, in conjunction with elements of the invention.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in *The British Journal of Photography Annual* of 1988, pages 191–198. Motion picture films may be processed as described in Kodak Publication No. H-24, Manual For Processing Eastman Color Films. Where applicable, the element may be processed in accordance with color print processes, such as the RA-4 process of Eastman Kodak Company as described in the *British Journal of Photography Annual* of 1988, pages 198–199, the Kodak Ektaprint 2 Process as described in Kodak Publication No. Z-122, using Kodak Ektaprint chemicals, and the Kodak ECP Process as described in Kodak Publication No. H-24, Manual For Processing Eastman Color Films. To provide a positive (or reversal) image, the color development step can be preceded by development with a non-chromogenic developing agent to develop exposed silver halide, but not form dye, and followed by uniformly fogging the element to render unexposed silver halide developable. For elements that lack incorporated dye image formers, sequential reversal color development with developers containing dye image formers such as color couplers is illustrated by the Kodachrome K-14 process (see U.S. Pat. Nos. 2,252,718; 2,950,970; and 3,547,650). For elements that contain incorporated color couplers, the E-6 color reversal process is described in the *British Journal of Photography Annual* of 1977, pages 194–197. Alternatively, a direct positive emulsion can be employed to obtain a positive image.

In these color photographic systems, the color-forming coupler is incorporated in the light-sensitive photographic emulsion layer so that during development, it is available in the emulsion layer to react with the color developing agent that is oxidized by silver image development. Diffusible couplers are used in color developer solutions. Non-diffusing couplers are incorporated in photographic emulsion layers. When the dye image formed is to be used in situ, couplers are selected which form non-diffusing dyes. For image-transfer color processes, couplers are used which will produce diffusible dyes capable of being mordanted or fixed in the receiving sheet. The invention can also be use in conjunction with color photographic systems which produce black-and-white images from non-diffusing couplers as described by Edwards et al in International Publication No. WO 93/012465.

Photographic color light-sensitive materials often utilize silver halide emulsions where the halide, for example chloride, bromide and iodide, is present as a mixture or combination of at least two halides. The combinations significantly influence the performance characteristics of the silver halide emulsion. As explained in Atwell, U.S. Pat. No. 4,269,927, silver halide with a high chloride content, that is, light-sensitive materials in which the silver halide grains are at least 80 mole percent silver chloride, possesses a number of highly advantageous characteristics. For example, silver chloride possesses less native sensitivity in the visible region of the spectrum than silver bromide, thereby permitting yellow filter layers to be omitted from multicolor photographic light-sensitive materials. However, if desired, the use of yellow filter layers should not be excluded from consideration for a light sensitive material. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps of 1) color development (for color reversal light-sensitive materials, black-and-white first development is necessary) and 2) desilvering. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used may be liquids, pastes, or solids, such as powders, tablets or granules.

In color development, silver halide that has been exposed to light (or a reversal bath for color reversal) is reduced to silver, and at the same time, the oxidized aromatic primary amine color developing agent is consumed by the above mentioned reaction to form image dyes. In this process halide ions from the silver halide grains are dissolved into the developer, where they will accumulate. In addition the color developing agent is consumed by the afore-mentioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution is applied:

1) color developing→bleach-fixing→washing/stabilizing;

2) color developing→bleaching→fixing→washing/stabilizing;

3) color developing→bleaching→bleach-fixing→washing/stabilizing;

4) color developing→stopping→washing→bleaching→washing→fixing→washing/stabilizing;

5) color developing-→bleach-fixing→fixing→washing/stabilizing;

6) color developing→bleaching→bleach-fixing→fixing→washing/stabilizing.

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; W0 92/17370; WO 91/19226; WO 91/12567; WO 92/07302; W0 93/00612; WO 92/07301; WO 92/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The color developing solution used with this photographic element may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, p-toluene-sulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present photographic element:

4-amino-3-methyl-N-ethyl-N-(β-hydroxyethyl)aniline sulfate, 4-amino-3-methyl-N-ethyl-N-(β-(methanesulfonamidoethyl)aniline sesquisulfate hydrate, 4-amino-N,N-diethylaniline hydrochloride, 4-amino-3-methyl-N,N-diethylaniline hydrochloride, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

EXAMPLES

Example 1

Preparation of latex polymer P-1:

t-Butylacrylamide (400 g, Chemie Linz) was slurried with vigorous mixing in a solution of water (968 g) and surfactant F-3 (25.0 g of a 40% aqueous solution). This slurry was added continuously over 15 minutes to an 80° C. stirred 1 L Morton flask equipped with a condenser, under $N_2$ atmosphere, charged with water (600 g), surfactant F-3 (8.3 g of a 40% aqueous solution), and initiator (azobis(cyanovaleric acid) 75%, 4.0 g, Aldrich). The resulting translucent latex was stirred at 80° C. for an additional 2 h. The latex was cooled and filtered, yielding 1959 g latex at 21.3% solids. Photon correlation spectroscopy showed an average particle size of 0.067 microns. A sample of the latex was freeze-dried. Proton nuclear magnetic resonance results: $^1$H NMR (300 MHz, $CDCl_3$), δ=1.15 (s, 9H), 1.2–2.2 (m, 3H), 5.6–6.5 (s, broad, 1H). Differential scanning calorimetry (DSC) showed a $T_g$ of 146° C.

Preparation of latex polymer P-31:

Methyl methacrylate (500 g) was combined with water (925 g) and surfactant F-3 (25.0 g of a 40% aqueous solution). The monomer emulsion was pumped over ca. 60 minutes into an 80° C. stirred Morton flask equipped with a condenser, under $N_2$ atmosphere, charged with water (625 g), surfactant F-3 (8.3 g of a 40% aqueous solution), and initiator potassium persulfate, 5.0 g. The resulting latex was stirred at 80° C. for an additional 240 minutes. The latex was cooled and filtered, yielding 1933 g latex at 26.26% solids. Photon correlation spectroscopy showed an average particle size of 0.064 microns.

These examples show that useful latex polymers, including polymers with high $T_g$ above 60° C. and even above 90° C. can be readily prepared by an emulsion polymerization process that uses no volatile or water-miscible organic solvent, and that such polymerization is also possible for polymers derived from solid, hydrophobic monomers that do not dissolve substantially in water.

While both of these polymers form useful loaded latex dispersion of the invention with desirable photographic properties, methods in the prior art for preparing loaded latex dispersions are not suitable for use with these polymers. In particular, mixing the latex of either polymer P-1 or P-31 with an equal volume of water miscible organic solvent (specifically acetone, tetrahydrofuran, dimethylformamide, or acetonitrile) leads to rapid coagulation of the latex, showing that these polymers fail the "test of latex loadability" described in the prior art, e.g., in U.S. Pat. No. 4,203,716.

Example 2

Dispersion 101 was prepared by combining coupler Y-3 (45.0 g) and dibutyl phthalate (S-1) (25.2 g), and heating to 141° C., yielding an oil solution. This was combined with 329.8 g of an aqueous solution at 72° C. containing 39.0 g gelatin and 4.0 g surfactant F-1, and the mixture was mixed for three minutes at 72° C. with a blade mixer, yielding a moderately coarse dispersion. Average particle size, measured by PCS (Malvern Autosizer 2c) was found to be about 0.570 microns. (This particular PCS instrument can measure sizes this large, but in general measurements larger than about 0.350 microns tend to be somewhat imprecise, giving replication errors of about 0.050 microns on repeated measurements of the same sample.)

Dispersion 102 was prepared by combining 8.0 g of dispersion 101, at 45° C., with 7.0 g of water at 45° C., and stirring the mixture by hand to obtain a uniform mixture. The sample was maintained at 45° C. in a sealed container.

Dispersions 103–105 were prepared similarly to dispersion 102, by combining 8.0 g of dispersion 101 with 7.0 g of an aqueous polymer latex of polymer P-1, with an average latex particle size of 0.067 microns, at the proper polymer concentration to achieve ratios of coupler Y-3: polymer P-1 of 1.0:0.5, 1.0:1.0, and 1.0:1.5 respectively.

Dispersions 106–108 were prepared similarly to dispersion 103–105, by combining 8.0 g of dispersion 101 with 7.0 g of an aqueous polymer latex of polymer P-15, ($T_g$=24° C.) with an average latex particle size of 0.120 microns, at the proper polymer concentration to achieve ratios of coupler Y-3: polymer P-15 of 1.0:05, 1.0:1.0, and 1.0:1.5 respectively.

Dispersion 201 was prepared by passing 120 g of dispersion 101 three times at 72° C. through a Microfluidizer model 110 homogenizer at a pressure of 68 MPa, yielding a fine-particle photographic dispersion. Average particle size by PCS was found to be about 0.300 microns.

Dispersions 202–208 were prepared similarly to dispersions 102–108, comprising the same components, but by combining 8.0 g of the finer particle dispersion 201 with 7.0 g of water or an aqueous polymer latex of polymer P-1 or P-15, to achieve the coupler Y-3: polymer ratios of 1.0:0.5, 1.0:1.0, and 1.0:1.5.

The samples were maintained at 45° C. without stirring after being prepared, and the apparent particle size was measured by PCS at various times after the samples were prepared. As mentioned before, PCS measurements are most sensitive to the larger size particles in a broad distribution, so the measurement effectively measures the larger coupler dispersion particles in the freshly prepared dispersions, rather than the much smaller latex particles. The PCS results are shown in the following tables, for samples 102–108, and 202–208.

| Sample | Latex | Coupler: Latex Ratio | PCS at 8 min, μm | PCS at 132 min, μm | PCS at 1440 min, μm | Comment |
|---|---|---|---|---|---|---|
| 102 | — | 1.0:1.0 | 0.564 | 0.541 | 0.670 | Comparison |
| 103 | P-1 | 1.0:0.5 | 0.692 | 0.543 | 0.268 | Invention |
| 104 | P-1 | 1.0:1.0 | 0.614 | 0.614 | 0.200 | Invention |
| 105 | P-1 | 1.0:1.5 | 0.623 | 0.410 | 0.186 | Invention |
| 106 | P-15 | 1.0:0.5 | 0.574 | 0.288 | 0.282 | Invention |
| 107 | P-15 | 1.0:1.0 | 0.404 | 0.225 | 0.243 | Invention |
| 108 | P-15 | 1.0:1.5 | 0.333 | 0.150 | 0.190 | Invention |

| Sample | Latex | Coupler: Latex Ratio | PCS at 8 min, μm | PCS at 1440 min, μm | Comment |
|---|---|---|---|---|---|
| 202 | — | 1.0:1.0 | 0.309 | 0.273 | Comparison |
| 203 | P-1 | 1.0:0.5 | 0.258 | 0.189 | Invention |
| 204 | P-1 | 1.0:1.0 | 0.280 | 0.129 | Invention |
| 205 | P-1 | 1.0:1.5 | 0.266 | 0.135 | Invention |
| 206 | P-15 | 1.0:0.5 | 0.261 | 0.196 | Invention |
| 207 | P-15 | 1.0:1.0 | 0.252 | 0.180 | Invention |
| 208 | P-15 | 1.0:1.5 | 0.222 | 0.179 | Invention |

As can be seen from the tables, the particle size of the comparison example 102 remains essentially unchanged during the experiment, within the accuracy of the measurement technique for such large particles. The dispersions of the invention, 103–108 all show a significant net decrease in measured particle size. Visual turbidity changes also corroborate this, with the comparison sample 102 remaining turbid and visually unchanged throughout the experiment, but the dispersions of the invention all became markedly less turbid. As can also be seen, the effect of increasing latex level in the dispersions, for both polymer P-1 and polymer P-15, is to accelerate the rate of particle size reduction and decrease the final particle size measured at 1440 minutes. Also apparent is the effect of the polymer identity on the rate of particle size decrease with time. Polymer P-15 decreases particle size rapidly, even after only 8 minutes, particularly at the highest level, while little particle size change is apparent for any of the samples containing polymer P-1 at 8 minutes. At 132 minutes, most of the particle size reduction has already occurred for polymer P-15, and comparatively modest size reductions have occurred for the samples containing polymer P-1. Presumably, this faster rate of latex loading with polymer P-15 compared to polymer P-1, evidenced by a more rapid particle size reduction, is due primarily to the much lower $T_g$ of polymer P-15. Similar trends are observed for samples 202–208, where the loaded latex dispersions of the invention were prepared by combining a conventional small-particle dispersion with the latex. Little particle size change is noted for the comparison dispersion 202 with no latex. It is also notable that polymer P-15 appears to load more rapidly for samples 206–208, but that an ultimately smaller particle size is obtained for samples 203–205 containing polymer P-1.

Example 3

Dispersion 301 was prepared by combining coupler Y-3 (237.7 g) and dibutyl phthalate (S-1) (133.1 g), and heating to 141° C., yielding an oil solution. This was added to 1640 g of an aqueous solution at 80° C., rapidly stirred with a rotor-stator mixer, said solution containing 156.0 g gelatin and 14.4 g surfactant F-1, yielding a coarse dispersion. This dispersion was homogenized at 34 MPa with a Crepaco homogenizer to yield a fine-particle photographic dispersion, with and average particle size (by PCS) of 0.277 microns. The dispersion was chill-set before being remelted for coating.

Dispersion 302 was prepared by adding polymer latex P-1, with low-shear mixing, to a freshly prepared sample of dispersion 301, in an amount such that the coupler Y-3: Polymer P-1 ratio was 1.00:0.80. The dispersion was stirred at 50° C. for 30 minutes before chill-setting. The average particle size of the dispersion measured by PCS was 0.145 microns.

Dispersion 303 was prepared in the same manner as dispersion 302, with a coupler Y-3: Polymer P-1 ratio of 1.00:0.60.

Coating sample 401, a blue-sensitive photographic element containing dispersion 301 in the emulsion layer was prepared by simultaneously coating the following layers.

| LAYER | COMPONENT | AMOUNT |
|---|---|---|
| 3 | F-2 | 0.004 g/m$^2$ |
| | Gelatin | 1.076 g/m$^2$ |
| 2 | UV-1 | 0.113 g/m$^2$ |
| | UV-2 | 0.640 g/m$^2$ |
| | ST-4 | 0.086 g/m$^2$ |
| | S-8 | 0.251 g/m$^2$ |
| | Gelatin | 1.399 g/m$^2$ |
| 1 | AG-1 Blue sensitive Ag | 0.247 g Ag/m$^2$ |
| | Y-3 from dispersion 301 | 0.538 g/m$^2$ |
| | ST-15 | 0.009 g/m$^2$ |
| | Gelatin | 1.539 g/m$^2$ |
| Support | Polyethylene laminated paper with $TiO_2$/ZnO in the polyethylene laminated in the first layer side, precoated with 3.23 g/m$^2$ gelatin. | |

In the layer 2, bis(vinylsulfonylmethyl) ether (0.143 g/m$^2$) was added as hardener.

AG-1 Blue Emulsion: A high chloride silver halide emulsion was precipitated by equimolar addition of silver nitrate and sodium chloride solutions into a well-stirred reactor containing gelatin peptizer and thioether ripener. $Cs_2OS(NO)Cl_5$ was added during the silver halide grain formation for most of the precipitation, followed by shelling without dopant. The resultant emulsion contained cubic shaped grains of 0.74 μm in edgelength size. This emulsion was optimally sensitized by the addition of water insoluble gold compound and heat ramped up to 60° C. during which time blue sensitizing dye BSD-1, 1-(3-acetamidophenyl)-5-mercaptotetrazole and potassium bromide were added. In addition, iridium dopant was added during the sensitization process.

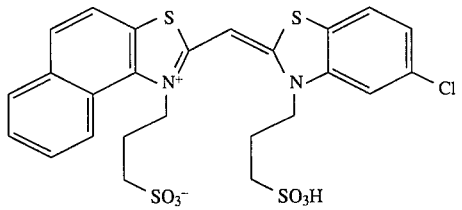

BSD-1

Coating samples 402–407 were prepared in the same manner as sample 401, using dispersion 301, to which polymer latex P-1 was added to the coating melt at various times before being applied to the support. The time the melt was held between adding the polymer and coating is shown in the table below. In each coating the coupler Y-3: polymer P-1 ratio was 1.00:0.80.

Coating sample 408 was prepared in the same manner as sample 401, using dispersion 302.

Coating sample 409 was prepared in the same manner as sample 401, using dispersion 301, to which polymer latex P-1 in a coupler Y-3: polymer P-1 ratio of 1.00:0.60 was added to the coating melt 45 minutes before being applied to the support.

Coating sample 410 was prepared in the same manner as sample 401, using dispersion 303.

The coatings 401–410 were exposed for 0.10 s at a color temperature of 3000 K. through a Wratten W98 filter and a 0–3 density 21-step tablet, and were processed through the Kodak RA-4 process, described in the British Journal of Photography Annual of 1988, Pp 198–199, comprising the following processing solutions, times and temperatures.

| Kodak RA-4 process | | |
|---|---|---|
| Developer | 0'45" | 350° C. |
| Bleach-Fix | 0'45" | 350° C. |
| Wash | 1'30" | 33–34° C. |

The processed coatings were subjected to 14 day 50 klx irradiation with a daylight source. The light stability of each coating was measured as blue reflection density loss from density 1.0 and 0.5. Also, each processed coating was subjected to 28 days in a dark oven at 75° C. and 50% R.H., and the density loss from density 1.7 was measured. The results are shown in the table below.

| Sample | Coupler: Polymer P-1 Ratio | Melt Time After P-1 Added | 14 Day 50 klx Loss From 1.0 | 14 Day 50 klx Loss From 0.5 | 28 Day 75° C. 50% RH Loss From 1.7 | Comment |
|---|---|---|---|---|---|---|
| 401 | 1.0:0.0 | — | −0.50 | −0.29 | −0.12 | Comparison |
| 402 | 1.0:0.8 | 1 min | −0.32 | −0.20 | −0.05 | Invention |
| 403 | 1.0:0.8 | 5 min | −0.31 | −0.20 | −0.04 | Invention |
| 404 | 1.0:0.8 | 10 min | −0.30 | −0.20 | −0.05 | Invention |
| 405 | 1.0:0.8 | 20 min | −0.28 | −0.19 | −0.05 | Invention |
| 406 | 1.0:0.8 | 30 min | −0.25 | −0.16 | −0.04 | Invention |
| 407 | 1.0:0.8 | 45 min | −0.18 | −0.12 | −0.04 | Invention |
| 408 | 1.0:0.8 | >200 min | −0.14 | −0.09 | −0.04 | Invention |
| 409 | 1.0:0.6 | 45 min | −0.23 | −0.15 | −0.05 | Invention |
| 410 | 1.0:0.6 | >200 min | −0.19 | −0.12 | −0.05 | Invention |

As is evident from the table, the photographic elements of the invention show substantially improved image preservability toward both heat and light in comparison the sample containing no polymer. The time dependence of latex loading is also apparent from 402–408, with longer melt times after the addition of the latex polymer allowing more loading to occur, as manifest by improved light stability of the image formed. Comparison of sample 407 with 409, and 408 with 410 shows the expected trend that improved image preservability results from increasing amounts of polymer latex in the dispersion.

Example 4

A dispersion was prepared by combining coupler Y-3 (30.0 g), stabilizer ST-6 (13.2 g) and dibutyl phthalate (S-1) (16.8 g), and heating to 141° C., yielding an oil solution. This was combined with 440 g of an aqueous solution at 70° C. containing 26.0 g gelatin and 2.4 g surfactant F-1, and the combination at 70° C. was mixed for 3 minutes with a blade mixer, yielding a coarse dispersion. This dispersion was homogenized at 68 MPa with a Microfluidizer model 110 homogenizer to yield a fine-particle dispersion. The dispersion was chill-set before use.

Coating sample 501, a blue-sensitive photographic element containing this dispersion in the emulsion layer was prepared by sequentially coating the following layers on a support.

| LAYER | COMPONENT | AMOUNT |
|---|---|---|
| 2 | F-1 | 0.054 g/m$^2$ |
| | F-2 | 0.004 g/m$^2$ |
| | Dye-1 | 0.018 g/m$^2$ |
| | Gelatin | 1.076 g/m$^2$ |
| 1 | AG-1 Blue sensitive Ag | 0.247 g Ag/m$^2$ |
| | Y-3 | 0.538 g/m$^2$ |
| | ST-6 | 0.237 g/m$^2$ |
| | S-1 | 0.301 g/m$^2$ |
| | ST-15 | 0.009 g/m$^2$ |
| | F-1 | 0.054 g/m$^2$ |
| | Gelatin | 1.539 g/m$^2$ |
| Support | Polyethylene laminated paper with $TiO_2$/ZnO in the polyethylene laminated in the first layer side, precoated with 3.23 g/m$^2$ gelatin. | |

In the final layer bis(vinylsulfonylmethyl) ether (0.105 g/m$^2$) was added as hardener.

Coating sample 502 was prepared in a similar manner, adding the appropriate amount of latex polymer P-1 to achieve a coating with 0.430 g/m$^2$ polymer, to the coatings solution approximately 2 hours before the coating was prepared. In a similar manner, coating samples 503–532 were prepared with the variations of dispersion components and polymer changes in the emulsion layer 1 shown in the table below.

| Sample | Coupler, g/m$^2$ | Latex, g/m$^2$ | ST-6, g/m$^2$ | S-1 g/m$^2$ | Comment |
|---|---|---|---|---|---|
| 501 | Y-3, 0.538 | — | 0.237 | 0.301 | Comparison |
| 502 | Y-3, 0.538 | P-1, 0.430 | 0.237 | 0.301 | Invention |
| 503 | Y-3, 0.538 | — | — | 0.301 | Comparison |
| 504 | Y-3, 0.538 | P-1, 0.430 | — | 0.301 | Invention |
| 505 | Y-16, 0.969 | — | 0.426 | 0.542 | Comparison |
| 506 | Y-16, 0.969 | P-1, 0.581 | 0.426 | 0.542 | Invention |
| 507 | Y-16, 0.969 | P-1, 1.162 | 0.426 | 0.542 | Invention |
| 508 | Y-16, 0.969 | — | — | 0.542 | Comparison |
| 509 | Y-16, 0.969 | P-1, 0.581 | — | 0.542 | Invention |
| 510 | Y-16, 0.969 | P-1, 1.162 | — | 0.542 | Invention |
| 511 | Y-11, 0.538 | — | — | 0.301 | Comparison |
| 512 | Y-11, 0.538 | P-1, 0.538 | — | 0.301 | Invention |
| 513 | Y-11, 0.538 | P-1, 1.076 | — | 0.301 | Invention |
| 514 | Y-11, 0.538 | — | 0.237 | 0.301 | Comparison |
| 515 | Y-11, 0.538 | P-1, 0.538 | 0.237 | 0.301 | Invention |
| 516 | Y-11, 0.538 | P-1, 1.076 | 0.237 | 0.301 | Invention |
| 517 | Y-12, 0.538 | — | — | 0.301 | Comparison |
| 518 | Y-12, 0.538 | P-1, 0.538 | — | 0.301 | Invention |
| 519 | Y-12, 0.538 | P-1, 1.076 | — | 0.301 | Invention |
| 520 | Y-12, 0.538 | P-17, 1.076 | — | 0.301 | Invention |
| 521 | Y-12, 0.538 | — | 0.237 | 0.301 | Comparison |
| 522 | Y-12, 0.538 | P-1, 0.538 | 0.237 | 0.301 | Invention |
| 523 | Y-12, 0.538 | P-1, 1.076 | 0.237 | 0.301 | Invention |
| 524 | Y-12, 0.538 | P-17, 1.076 | 0.237 | 0.301 | Invention |
| 525 | Y-13, 0.538 | — | — | 0.301 | Comparison |
| 526 | Y-13, 0.538 | P-1, 0.538 | — | 0.301 | Invention |
| 527 | Y-13, 0.538 | P-1, 1.076 | — | 0.301 | Invention |
| 528 | Y-13, 0.538 | P-17, 1.076 | — | 0.301 | Invention |
| 529 | Y-13, 0.538 | — | 0.237 | 0.301 | Comparison |
| 530 | Y-13, 0.538 | P-1, 0.538 | 0.237 | 0.301 | Invention |
| 531 | Y-13, 0.538 | P-1, 1.076 | 0.237 | 0.301 | Invention |
| 532 | Y-13, 0.538 | P-17, 1.076 | 0.237 | 0.301 | Invention |

The coatings 501–532 were exposed for 0.10 s at a color temperature of 3000 K through a Wratten W98 filter and a 0–3 density 21-step tablet, and were processed through the Kodak RA-4 process described above.

To obtain light stability information, each coating was covered with a UV filter layer coated on cellulose acetate support, containing 0.65 g/m$^2$ of a 15:85 by weight mixture of UV absorbers UV-1 and UV-2, 0.22 g/m$^2$ of solvent S-8, 0.074 g/m$^2$ of ST-4, and 1.26 g/m$^2$ of gelatin. The coatings were subjected to 14 day 50 klx irradiation with a daylight source. The light stability of the coating was measured as blue reflection density loss from density 1.7, 1.0 and 0.5.

The hue of each processed coating was also measured at the exposure step nearest a blue optical density of 1.0. The position of the bathochromic edge of the absorption curve is indicated in the next column, which gives a normalized density at 500 nm, relative to a density of 1.0 at $\lambda_{max}$ for the dye. A smaller number means a sharper-cutting bathochromic edge of the dye absorption envelope. The results are shown in the table below.

| Sample | Coupler, Polymer | 14 Day 50 klx Loss From 1.7 | 14 Day 50 klx Loss From 1.0 | 14 Day 50 klx Loss From 0.5 | Hue, 500 nm | Comment |
|---|---|---|---|---|---|---|
| 501 | Y-3, — | −0.31 | −0.18 | −0.15 | 0.572 | Comparison |
| 502 | Y-3, P-1 | −0.17 | −0.10 | −0.08 | 0.497 | Invention |
| 503 | Y-3, — | −0.91 | −0.54 | −0.33 | 0.577 | Comparison |
| 504 | Y-3, P-1 | −0.29 | −0.17 | −0.13 | 0.482 | Invention |
| 505 | Y-16, — | −0.48 | −0.22 | −0.17 | 0.399 | Comparison |
| 506 | Y-16, P-1 | −0.37 | −0.16 | −0.11 | 0.397 | Invention |
| 507 | Y-16, P-1 | −0.23 | −0.10 | −0.08 | 0.430 | Invention |
| 508 | Y-16, — | −0.64 | −0.30 | −0.20 | 0.443 | Comparison |
| 509 | Y-16, P-1 | −0.40 | −0.16 | −0.09 | 0.442 | Invention |
| 510 | Y-16, P-1 | −0.20 | −0.10 | −0.08 | 0.433 | Invention |
| 511 | Y-11, — | −0.92 | −0.67 | −0.39 | 0.535 | Comparison |
| 512 | Y-11, P-1 | −0.35 | −0.22 | −0.18 | 0.510 | Invention |
| 513 | Y-11, P-1 | −0.20 | −0.14 | −0.12 | 0.499 | Invention |
| 514 | Y-11, — | −0.26 | −0.18 | −0.21 | 0.522 | Comparison |
| 515 | Y-11, P-1 | −0.18 | −0.12 | −0.15 | 0.511 | Invention |
| 516 | Y-11, P-1 | −0.10 | −0.10 | −0.09 | 0.502 | Invention |
| 517 | Y-12, — | −1.18 | −0.78 | −0.40 | 0.512 | Comparison |
| 518 | Y-12, P-1 | −0.48 | −0.30 | −0.21 | 0.498 | Invention |
| 519 | Y-12, P-1 | −0.24 | −0.16 | −0.12 | 0.487 | Invention |
| 520 | Y-12, P-17 | −0.51 | −0.38 | −0.32 | 0.497 | Invention |

-continued

| Sample | Coupler, Polymer | 14 Day 50 klx Loss From 1.7 | 14 Day 50 klx Loss From 1.0 | 14 Day 50 klx Loss From 0.5 | Hue, 500 nm | Comment |
|---|---|---|---|---|---|---|
| 521 | Y-12, — | −0.31 | −0.24 | −0.27 | 0.509 | Comparison |
| 522 | Y-12, P-1 | −0.17 | −0.15 | −0.16 | 0.492 | Invention |
| 523 | Y-12, P-1 | −0.11 | −0.09 | −0.09 | 0.487 | Invention |
| 524 | Y-12, P-17 | −0.24 | −0.17 | −0.18 | 0.495 | Invention |
| 525 | Y-13, — | −1.17 | −0.72 | −0.38 | 0.527 | Comparison |
| 526 | Y-13, P-1 | −0.87 | −0.56 | −0.33 | 0.523 | Invention |
| 527 | Y-13, P-1 | −0.48 | −0.32 | −0.26 | 0.516 | Invention |
| 528 | Y-13, P-17 | −0.61 | −0.37 | −0.29 | 0.521 | Invention |
| 529 | Y-13, — | −0.23 | −0.18 | −0.21 | 0.510 | Comparison |
| 530 | Y-13, P-1 | −0.19 | −0.15 | −0.20 | 0.511 | Invention |
| 531 | Y-13, P-1 | −0.13 | −0.12 | −0.15 | 0.507 | Invention |
| 532 | Y-13, P-17 | −0.20 | −0.17 | −0.19 | 0.516 | Invention |

As can be seen from the table, the latex-loaded photographic elements of the invention all show decreased dye fade on irradiation relative to the corresponding comparison elements without polymer. Most of the elements of the invention also have less unwanted absorption of green light by the yellow dye, relative the the corresponding comparison elements without polymer.

Coating samples 601–616 were prepared similarly to coating 503, using coupler Y-3 (0.538 g/m$^2$) and S-1 (0.301 g/m$^2$) in the emulsion layer 1, adding latex polymers to the coating solutions in the amounts shown in the table below. The coatings 601–616 were exposed and processed in the same manner as coating 503. The reactivity of the coupler was determined by measuring the maximum dye density formed for each coating. The hue of the dye formed and the stability of the image to irradiation were evaluated in the same manner as coating 503.

| Sample | Polymer, g/m$^2$ | Blue Dmax | 14 Day 50 klx Loss From 1.7 | 14 Day 50 klx Loss From 1.0 | 14 Day 50 klx Loss From 0.5 | Hue, 500 nm | Comment |
|---|---|---|---|---|---|---|---|
| 503 | — | 2.59 | −0.91 | −0.54 | −0.33 | 0.577 | Comparison |
| 601 | P-1, 0.538 | 2.53 | −0.24 | −0.12 | −0.10 | 0.504 | Invention |
| 602 | P-41, 0.538 | 2.60 | −0.14 | −0.09 | −0.06 | 0.500 | Invention |
| 603 | P-42, 0.538 | 2.57 | −0.15 | −0.08 | −0.06 | 0.503 | Invention |
| 604 | P-43, 0.538 | 2.59 | −0.18 | −0.11 | −0.07 | 0.504 | Invention |
| 605 | P-44, 0.538 | 2.58 | −0.22 | −0.10 | −0.06 | 0.500 | Invention |
| 606 | P-45, 0.538 | 2.58 | −0.18 | −0.11 | −0.06 | 0.501 | Invention |
| 607 | P-44, 0.753 | 2.47 | −0.20 | −0.10 | −0.05 | 0.490 | Invention |
| 608 | P-44, 0.969 | 2.35 | −0.11 | −0.05 | −0.02 | 0.483 | Invention |
| 609 | P-46, 0.538 | 2.60 | −0.25 | −0.13 | −0.10 | 0.508 | Invention |
| 610 | P-47, 0.538 | 2.62 | −0.20 | −0.11 | −0.07 | 0.505 | Invention |
| 611 | P-48, 0.538 | 2.63 | −0.18 | −0.10 | −0.06 | 0.502 | Invention |
| 612 | P-31, 0.538 | 2.63 | −0.50 | −0.30 | −0.22 | 0.540 | Invention |
| 613 | P-49, 0.538 | 2.65 | −0.29 | −0.17 | −0.12 | 0.521 | Invention |
| 614 | P-50, 0.538 | 2.74 | −0.22 | −0.14 | −0.10 | 0.529 | Invention |
| 615 | P-51, 0.538 | 2.75 | −0.25 | −0.12 | −0.10 | 0.525 | Invention |
| 616 | P-52, 0.538 | 2.66 | −0.24 | −0.13 | −0.11 | 0.524 | Invention |

It is apparent from this table that many polymers and copolymers may be advantageously employed in the photographic elements of the invention. The polymer containing coatings of the invention all show excellent dye-forming properties and high dye densities. The coating samples with the various polymers and copolymers all exhibit improved stability of the image dye toward irradiation, as well as improved dye hue.

Example 5

A dispersion was prepared by combining coupler C-13 (42.66 g), dibutyl phthalate (S-1) (23.46 g), solvent S-14 (3.50 g) and stabilizer ST-4 (0.35 g), heating to 141° C., yielding an oil solution. This was combined with 380 g of a solution containing 42.66 g gelatin, 3.06 g surfactant F-1, and 334.28 g of water, and the mixture was mixed briefly with a blade mixer to yield a coarse dispersion (particle size>>1 micron). The coarse dispersion was recycled for two turnovers at 68 MPa with a Microfluidizer model 110 homogenizer, yielding a fine particle dispersion.

Coating sample 701, a red-sensitive photographic element containing this dispersion and an additional dispersion of ST-4 dissolved in S-1 in the emulsion layer, was prepared by coating the following layers.

| LAYER | COMPONENT | AMOUNT |
|---|---|---|
| 2 | F-1 | 0.054 g/m$^2$ |
| | F-2 | 0.004 g/m$^2$ |
| | Gelatin | 1.076 g/m$^2$ |
| 1 | AG-3 Red sensitive Ag | 0.198 g Ag/m$^2$ |
| | C-13 | 0.423 g/m$^2$ |
| | S-1 | 0.238 g/m$^2$ |
| | ST-4 | 0.005 g/m$^2$ |
| | F-1 | 0.054 g/m$^2$ |
| | Gelatin | 1.292 g/m$^2$ |
| Support | Polyethylene laminated paper with $TiO_2$/ZnO in the polyethylene laminated in the first layer side, precoated with 3.23 g/m$^2$ gelatin. | |

In the final layer bis(vinylsulfonylmethyl) ether (0.100 g/m$^2$) was added as hardener.

AG-3 Red Emulsion: A high chloride silver halide emulsion was precipitated by equimolar addition of silver nitrate and sodium chloride solutions into a well-stirred reactor containing gelatin peptizer and thioether ripener. The resultant emulsion contained cubic shaped grains of 0.40 μm in edgelength size. This emulsion was optimally sensitized by the addition of water insoluble gold compound followed by a heat ramp, and further additions of 1-(3-acetamidophenyl)-5-mercaptotetrazole, potassium bromide and red sensitizing dye RSD-1. In addition, iridium and ruthenium dopants were added during the sensitization process.

Coating examples 702–712 were prepared similarly to example 701, adding the appropriate amount of latex polymer to the coating solution, at 40° C., approximately 1 hour before the coatings were prepared, as indicated in the table below.

The coatings were exposed for 0.10 s at a color temperature of 3000 K. through a Wratten W29 filter and a 0–3 density 21-step tablet, and were processed through the Kodak RA-4 process. The red density loss from 1.0 density for each coating was measured after treatment at 60° C. and 50% relative humidity for 28 and 42 days.

Three of the coatings, 701, 704, and 706 were tested for ferrous ion sensitivity by treating processed samples of each coating for 5 minutes at 40° C. in a nitrogen-purged solution prepared from water (7.0 L), ethylenediaminetetraacetic acid (EDTA, 256.8 g), $FeSO_4$ (222.4 g) adjusted to pH 5.00 with aqueous ammonia. The coatings were washed with water for 5 minutes, dried, and the density loss at 1.0 initial density was measured within 60 minutes.

| Sample | Polymer Latex/ Amount g/m$^2$ | 28 Day 60° C. 50% RH Loss | 42 Day 60° C. 50% RH Loss | Fe2+ Loss From 1.0 | Comment |
|---|---|---|---|---|---|
| 701 | — | −0.29 | −0.37 | −0.61 | Comparison |
| 702 | P-1/0.106 | −0.26 | −0.35 | — | Invention |
| 703 | P-1/0.212 | −0.23 | −0.31 | — | Invention |
| 704 | P-1/0.423 | −0.19 | −0.27 | −0.44 | Invention |
| 705 | P-1/0.635 | −0.09 | −0.15 | — | Invention |
| 706 | P-1/0.846 | −0.02 | −0.08 | −0.41 | Invention |
| 707 | P-17/0.212 | −0.29 | −0.37 | — | Invention |
| 708 | P-17/0.423 | −0.25 | −0.34 | — | Invention |
| 709 | P-17/0.846 | −0.22 | −0.30 | — | Invention |
| 710 | P-31/0.212 | −0.28 | −0.37 | — | Invention |
| 711 | P-31/0.423 | −0.25 | −0.34 | — | Invention |
| 712 | P-31/0.846 | −0.20 | −0.26 | — | Invention |

As can be seen from the table, the latex-containing coatings of this invention show improved dye thermal stability relative to the comparisons without polymer. Some dispersions of the invention also show decreased cyan leuco dye formation after treatments with ferrous ion.

Example 6

A dispersion containing coupler Y-3 and S-1 was prepared according to the same formula and procedure as dispersion 301 in example 2. Coating sample 801, a blue-sensitive photographic element containing this dispersion in the emulsion layer was prepared by coating the following layers simultaneously on a reflective support. The single emulsion layer is derived from two separate coating solutions that were maintained separately at 40° C. before coating, and were combined in an in-line mixer at the coating hopper immediately before being applied to the support. One solution, designated 1a, contained primarily the AgCl emulsion components, and the other, designated as 1b, contained primarily the yellow coupler dispersion. The gelatin in the coated layer 1 was divided equally between the two coating solutions.

| LAYER | COMPONENT | AMOUNT |
|---|---|---|
| 3 | F-2 | 0.004 g/m$^2$ |
| | Gelatin | 1.076 g/m$^2$ |
| 2 | UV-1 | 0.113 g/m$^2$ |
| | UV-2 | 0.640 g/m$^2$ |
| | ST-4 | 0.086 g/m$^2$ |
| | S-8 | 0.251 g/m$^2$ |
| | Gelatin | 1.399 g/m$^2$ |
| 1a | AG-1 Blue sensitive Ag | 0.258 g Ag/m$^2$ |
| | Gelatin | 0.829 g/m$^2$ |
| 1b | Y-3 from dispersion | 0.538 g/m$^2$ |
| | S-1 from dispersion | 0.301 g/m$^2$ |
| | $HgCl_2$ | 0.002 mg/m$^2$ |
| | ST-15 | 0.009 g/m$^2$ |
| | Gelatin | 0.829 g/m$^2$ |
| Support | Polyethylene laminated paper with $TiO_2$/ZnO in the polyethylene laminated in the first layer side, precoated with 3.23 g/m$^2$ gelatin. | |

In the layer 2, bis(vinylsulfonylmethyl) ether (0.145 g/m$^2$) was added as hardener.

Coating samples 802–810 were prepared as shown in the following table, by adding the appropriate amount of polymer latex to achieve the desired amount of polymer in the coating. The latex was added either to coating solution 1a or 1b approximately one hour before the coating solutions were applied to the support, and the solutions were maintained at 40° C. with gentle stirring after the polymer addition until the coatings were prepared.

The coatings 801–810 were exposed for 0.10 s at a color temperature of 3000 K. through a Wratten W98 filter and a 0–3 density 21-step tablet, and were processed through the Kodak RA-4 process, as previously described. The processed coatings were subjected to 28 day 50 klx irradiation with a daylight source. The light stability of each coating was measured as blue reflection density loss from initial densities of 1.7, 1.0 and 0.5. The results are shown in the table below.

| Sample | Polymer, ($g/m^2$) From 1a | Polymer, ($g/m^2$) From 1b | 28 Day 50 klx Loss From 1.7 | 28 Day 50 klx Loss From 1.0 | 28 Day 50 klx Loss From 0.5 | Comment |
|---|---|---|---|---|---|---|
| 801 | — | — | −1.32 | −0.75 | −0.35 | Comparison |
| 802 | — | P-17, 0.54 | −0.72 | −0.45 | −0.30 | Invention |
| 803 | P-17, 0.54 | — | −0.70 | −0.44 | −0.30 | Invention |
| 804 | — | P-17, 1.08 | −0.43 | −0.27 | −0.26 | Invention |
| 805 | P-17, 1.08 | — | −0.45 | −0.27 | −0.25 | Invention |
| 806 | P-17, 0.54 | P-17, 0.54 | −0.40 | −0.26 | −0.24 | Invention |
| 807 | — | P-1, 0.32 | −0.73 | −0.42 | −0.24 | Invention |
| 808 | P-1, 0.32 | — | −1.09 | −0.65 | −0.32 | Invention |
| 809 | — | P-1, 0.43 | −0.66 | −0.40 | −0.25 | Invention |
| 810 | P-1, 0.43 | — | −1.04 | −0.62 | −0.32 | Invention |

As can be seen from the table, the polymer-containing photographic elements of the invention all exhibited improved light stability compared to the comparative example. The improvement observed in coatings 802–806 with polymer P-17, with a low polymer glass transition temperature ($T_g$=−42° C.), depended mostly on the amount of polymer introduced. Only minor differences were seen if the polymer was stirred for one hour with the coupler dispersion or was mixed with the dispersion at the coating hopper immediately before coating, or whether some polymer latex was added to each dispersion. This suggests that the low $T_g$ polymer P-17 forms a loaded latex dispersion very readily. This also demonstrates that the methods of preparing loaded latex dispersions can practically include procedures where a solution containing the polymer latex and a solution containing an oil dispersion are combined only an extremely short time before a photographic element is prepared by coating the combined solution.

While coatings 807–810 with polymer P-1 ($T_g$=145° C.) were all significantly improved over the comparative example 801, a larger improvement was seen for the coatings prepared by stirring the polymer for one hour with the dispersion, than for the coatings where the polymer was combined with the dispersion at the coating hopper. This suggests that loading into the high $T_g$ polymer P-1 occurs more slowly than for polymers with lower $T_g$.

Another advantage of the dispersions of the invention is that the hue of the yellow dye formed in all of the coatings of the invention was more pure than that formed in the comparative example 801, showing substantially less unwanted absorption of green light. This was especially pronounced for the coatings with the highest level of polymer P-17, coatings 804–806, as well as samples 807 and 809 containing polymer P-1.

Example 7

Coating sample 901 was prepared by coating the following layers on a paper support.

| LAYER | COMPONENT | AMOUNT |
|---|---|---|
| 7 | ST-4 | 0.022 $g/m^2$ |
| | S-1 | 0.065 $g/m^2$ |
| | F-1 | 0.009 $g/m^2$ |
| | F-2 | 0.004 $g/m^2$ |
| | Dye-1 | 0.018 $g/m^2$ |
| | Dye-2 | 0.009 $g/m^2$ |
| | Dye-3 | 0.007 $g/m^2$ |
| | Gelatin | 1.076 $g/m^2$ |
| 6 | UV-1 | 0.049 $g/m^2$ |
| | UV-2 | 0.279 $g/m^2$ |
| | ST-4 | 0.080 $g/m^2$ |
| | S-8 | 0.109 $g/m^2$ |
| | S-1 | 0.129 $g/m^2$ |
| | Gelatin | 0.630 $g/m^2$ |
| 5 | AG-3 Red sensitive Ag | 0.218 g $Ag/m^2$ |
| | C-3 | 0.423 $g/m^2$ |
| | S-1 | 0.232 $g/m^2$ |
| | S-14 | 0.035 $g/m^2$ |
| | ST-4 | 0.004 $g/m^2$ |
| | Gelatin | 1.087 $g/m^2$ |
| 4 | UV-1 | 0.049 $g/m^2$ |
| | UV-2 | 0.279 $g/m^2$ |
| | ST-4 | 0.080 $g/m^2$ |
| | S-8 | 0.109 $g/m^2$ |
| | S-1 | 0.129 $g/m^2$ |
| | Gelatin | 0.630 $g/m^2$ |
| 3 | AG-2 Green sensitive Ag | 0.263 g $Ag/m^2$ |
| | M-1 | 0.389 $g/m^2$ |
| | S-1 | 0.195 $g/m^2$ |
| | S-14 | 0.058 $g/m^2$ |
| | ST-2 | 0.166 $g/m^2$ |
| | ST-4 | 0.039 $g/m^2$ |
| | Gelatin | 1.270 $g/m^2$ |
| 2 | ST-4 | 0.094 $g/m^2$ |
| | S-1 | 0.282 $g/m^2$ |
| | ST-14 | 0.065 $g/m^2$ |
| | F-1 | 0.002 $g/m^2$ |
| | Gelatin | 0.753 $g/m^2$ |
| 1 | AG-1 Blue sensitive Ag | 0.243 g $Ag/m^2$ |
| | Y-3 | 0.538 $g/m^2$ |
| | ST-6 | 0.237 $g/m^2$ |
| | S-1 | 0.301 $g/m^2$ |
| | ST-15 | 0.009 $g/m^2$ |
| | glycerol | 0.162 $g/m^2$ |
| | Gelatin | 1.042 $g/m^2$ |
| Support | Polyethylene laminated paper with $TiO_2$/ZnO in the polyethylene laminated in the first layer side. | |

Bis(vinylsulfonylmethyl) ether (1.97% to total gelatin weight) was added as hardener.

AG-2 Green Emulsion: A high chloride silver halide emulsion was precipitated by equimolar addition of silver nitrate and sodium chloride solutions into a well-stirred reactor containing gelatin peptizer and thioether ripener. $Cs_2OS(NO)Cl_5$ dopant was added during the silver halide grain formation for most of the precipitation, followed by a shelling without dopant. Iridium dopant was added during the late stage of grain formation. The resultant emulsion contained cubic shaped grains of 0.30 μm in edgelength size. This emulsion was optimally sensitized with green sensitizing dye GSD-1, water insoluble gold compound, heat digestion followed by the addition of 1-(3-acetamidophenyl)-5-mercaptotetrazole and potassium bromide.

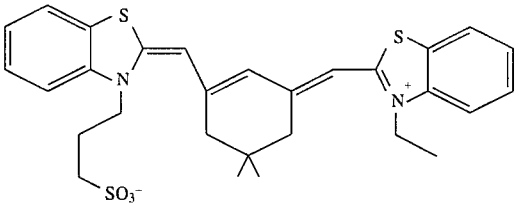

RSD-1

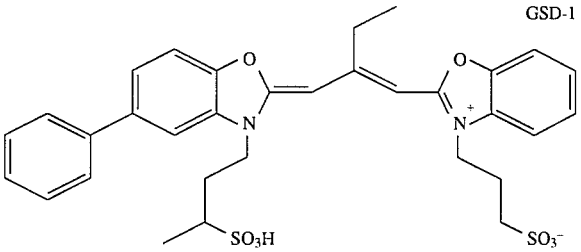

GSD-1

Absorber dyes used were the following:

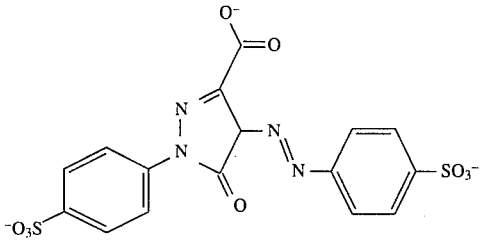

Dye-1

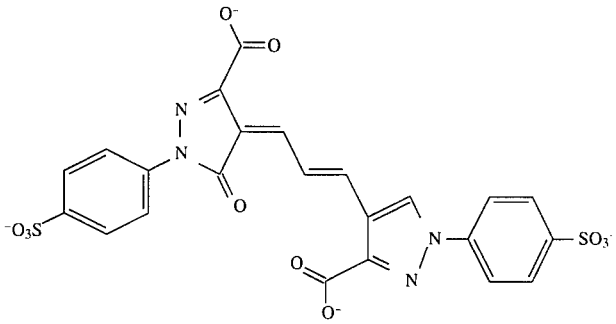

Dye-2

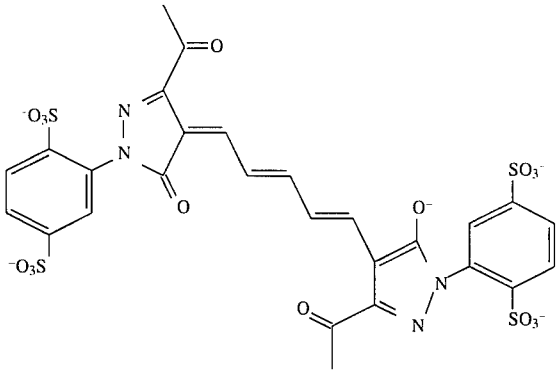

Dye-3

Coating samples 902–918 were prepared similarly to 901, changing the components of the blue-sensitive emulsion layer 1 as shown in the table below. The coating samples of the invention were all prepared by adding the latex polymer with gentle stirring to the coating solution containing the coupler dispersion at 40° C. approximately 1 hour before the coatings were prepared.

| Sample | Coupler, g/m² | Latex/ Size μm | Latex g/m² | ST-6 g/m² | S-1 g/m² | Comment |
|---|---|---|---|---|---|---|
| 901 | Y-3, 0.538 | — | — | 0.237 | 0.301 | Comparison |
| 902 | Y-3, 0.538 | P-17/0.163 | 1.076 | 0.237 | 0.301 | Invention |
| 903 | Y-3, 0.538 | P-17/0.163 | 1.076 | 0.237 | 0.463 | Invention |
| 904 | Y-3, 0.538 | P-15/0.120<br>P-17/0.163 | 0.538<br>0.538 | 0.237 | 0.301 | Invention |
| 905 | Y-3, 0.753 | P-1/0.067 | 0.430 | 0.332 | 0.421 | Invention |
| 906 | Y-3, 0.753 | — | — | — | 0.421 | Comparison |
| 907 | Y-3, 0.753 | P-1/0.067 | 0.452 | — | 0.421 | Invention |
| 908 | Y-3, 0.753 | P-1/0.067 | 0.602 | — | 0.421 | Invention |
| 909 | Y-3, 0.753 | P-1/0.067 | 0.753 | — | 0.421 | Invention |
| 910 | Y-3, 0.538 | P-15/0.120<br>P-17/0.163 | 0.538<br>0.538 | — | 0.301 | Invention |
| 911 | Y-11, 0.484 | — | — | 0.213 | 0.271 | Comparison |
| 912 | Y-11, 0.377 | P-1/0.067 | 0.754 | 0.166 | 0.211 | Invention |
| 913 | Y-11, 0.484 | P-1/0.067 | 0.968 | 0.213 | 0.271 | Invention |

-continued

| Sample | Coupler, g/m² | Latex/ Size μm | Latex g/m² | ST-6 g/m² | S-1 g/m² | Comment |
|---|---|---|---|---|---|---|
| 914 | Y-11, 0.592 | P-1/0.067 | 1.184 | 0.260 | 0.332 | Invention |
| 915 | Y-11, 0.484 | — | — | — | 0.301 | Comparison |
| 916 | Y-11, 0.377 | P-1/0.067 | 0.754 | — | 0.301 | Invention |

-continued

| Sample | Coupler, g/m² | Latex/ Size μm | Latex g/m² | ST-6 g/m² | S-1 g/m² | Comment |
|---|---|---|---|---|---|---|
| 917 | Y-11, 0.484 | P-1/0.067 | 0.968 | — | 0.301 | Invention |
| 918 | Y-11, 0.592 | P-1/0.067 | 1.184 | — | 0.301 | Invention |

The coatings 901–918 were exposed for 0.10 s at a color temperature of 3000 K. through a Wratten W98 filter and a 0–3 density 21-step tablet, and were processed through the Kodak RA-4 process, as previously described. The processed coatings were subjected to 28 day 50 klx irradiation with a daylight source. The light stability of each coating was measured as blue reflection density loss from initial densities of 1.7, 1.0 and 0.5. The results are shown in the table below.

| Sample | Coupler, Stabilizer | Polymer Latex/ Amount g/m² | 28 Day 50 klx Loss From 1.7 | 28 Day 50 klx Loss From 1.0 | 28 Day 50 klx Loss From 0.5 | Comment |
|---|---|---|---|---|---|---|
| 901 | Y-3, ST-6 | — | −0.97 | −0.63 | −0.33 | Comparison |
| 902 | Y-3, ST-6 | P-17/1.076 | −0.38 | −0.28 | −0.29 | Invention |
| 903 | Y-3, ST-6 | P-17/1.076 | −0.48 | −0.42 | −0.36 | Invention |
| 904 | Y-3, ST-6 | P-15/0.538 P-17/0.538 | −0.35 | −0.24 | −0.24 | Invention |
| 905 | Y-3, ST-6 | P-1/0.430 | −0.42 | −0.33 | −0.25 | Invention |
| 906 | Y-3, — | — | −1.32 | −0.79 | −0.40 | Comparison |
| 907 | Y-3, — | P-1/0.452 | −0.46 | −0.29 | −0.17 | Invention |
| 908 | Y-3, — | P-1/0.602 | −0.39 | −0.22 | −0.14 | Invention |
| 909 | Y-3, — | P-1/0.753 | −0.35 | −0.17 | −0.10 | Invention |
| 910 | Y-3, — | P-15/0.538 P-17/0.538 | −0.42 | −0.28 | −0.23 | Invention |
| 911 | Y-11, ST-6 | — | −0.56 | −0.52 | −0.41 | Comparison |
| 912 | Y-11, ST-6 | P-1/0.754 | −0.54 | −0.42 | −0.30 | Invention |
| 913 | Y-11, ST-6 | P-1/0.968 | −0.42 | −0.38 | −0.29 | Invention |
| 914 | Y-11, ST-6 | P-1/1.184 | −0.37 | −0.32 | −0.28 | Invention |
| 915 | Y-11, — | — | −1.45 | −0.86 | −0.42 | Comparison |
| 916 | Y-11, — | P-1/0.754 | −0.63 | −0.39 | −0.27 | Invention |
| 917 | Y-11, — | P-1/0.968 | −0.48 | −0.34 | −0.25 | Invention |
| 918 | Y-11, — | P-1/1.184 | −0.39 | −0.28 | −0.25 | Invention |

As can be seen from the table, the polymer-containing photographic elements of the invention all exhibited improved light stability compared to corresponding comparative examples.

The coating samples 901, 902, 905, and 907–909 were tested for wet scratch resistance and wet adhesion to the support after 28 days aging at ambient conditions. The samples were submerged in Kodak RA-4 developer solution at 35° C. for 45 seconds, and a perpendicular stylus with a spherical sapphire tip was drawn over the sample surface with a constantly increasing mass load. The load required for the stylus penetrate completely through the coating was measured for both styli of 0.20 mm and 0.38 mm diameter. The table below shows the average of the load for the two sizes of styli required to penetrate the coating.

| Sample | Average grams load | Comment |
|---|---|---|
| 901 | 47 | Comparison |
| 902 | 56 | Invention |
| 905 | 61 | Invention |
| 907 | 81 | Invention |

-continued

| Sample | Average grams load | Comment |
|---|---|---|
| 908 | 76 | Invention |
| 909 | 80 | Invention |

As can be seen from the table, many of the coatings of the invention showed excellent wet scratch resistance, requiring a higher load on the stylus for to scratch the wet coating, compared to the comparison example.

Example 8

A coating sample 1001 is prepared by simultaneously coating the following layers on a reflective support. The blue-sensitive emulsion layer 1 comprises a loaded-latex dispersion of coupler Y-11 prepared according to the invention.

| LAYER | COMPONENT | AMOUNT |
|---|---|---|
| 7 | ST-4 | 0.021 g/m² |
| | S-1 | 0.064 g/m² |
| | F-1 | 0.009 g/m² |
| | F-2 | 0.004 g/m² |
| | Dye-1 | 0.021 g/m² |
| | Dye-2 | 0.009 g/m² |
| | Dye-3 | 0.019 g/m² |
| | Gelatin | 1.076 g/m² |
| 6 | UV-1 | 0.073 g/m² |
| | UV-2 | 0.276 g/m² |
| | ST-4 | 0.050 g/m² |
| | S-8 | 0.109 g/m² |
| | S-1 | 0.129 g/m² |
| | Gelatin | 0.624 g/m² |
| 5 | AG-3 Red sensitive Ag | 0.212 g Ag/m² |
| | C-3 | 0.423 g/m² |
| | UV-2 | 0.272 g/m² |
| | S-1 | 0.415 g/m² |
| | S-14 | 0.035 g/m² |
| | ST-4 | 0.004 g/m² |
| | Gelatin | 1.388 g/m² |
| 4 | UV-1 | 0.073 g/m² |
| | UV-2 | 0.276 g/m² |
| | ST-4 | 0.050 g/m² |
| | S-8 | 0.109 g/m² |
| | S-1 | 0.129 g/m² |
| | Gelatin | 0.624 g/m² |
| 3 | AG-2 Green sensitive Ag | 0.174 g Ag/m² |
| | M-2 | 0.344 g/m² |
| | S-4 | 0.564 g/m² |
| | ST-3 | 0.107 g/m² |
| | ST-16 | 0.180 g/m² |
| | ST-5 | 0.180 g/m² |
| | Gelatin | 1.270 g/m² |
| 2 | ST-4 | 0.156 g/m² |
| | S-1 | 0.468 g/m² |
| | ST-14 | 0.065 g/m² |
| | F-1 | 0.002 g/m² |
| | Gelatin | 0.753 g/m² |
| 1 | AG-1 Blue sensitive Ag | 0.246 g Ag/m² |
| | Y-11 | 0.484 g/m² |
| | P-54 | 0.678 g/m² |
| | S-1 | 0.330 g/m² |
| | ST-15 | 0.009 g/m² |
| | Gelatin | 1.593 g/m² |
| Support | Polyethylene laminated paper with $TiO_2$/ZnO in the polyethylene laminated in the first layer side. | |

A coating sample 1002 is prepared by simultaneously coating the following layers on a reflective support. The blue-sensitive emulsion layer 1 comprises a loaded-latex dispersion of coupler Y-3 prepared according to the invention.

| LAYER | COMPONENT | AMOUNT |
|---|---|---|
| 7 | ST-4 | 0.021 g/m$^2$ |
| | S-1 | 0.064 g/m$^2$ |
| | F-1 | 0.009 g/m$^2$ |
| | F-2 | 0.004 g/m$^2$ |
| | Dye-1 | 0.021 g/m$^2$ |
| | Dye-2 | 0.009 g/m$^2$ |
| | Dye-3 | 0.019 g/m$^2$ |
| | Gelatin | 1.076 g/m$^2$ |
| 6 | UV-1 | 0.073 g/m$^2$ |
| | UV-2 | 0.276 g/m$^2$ |
| | ST-4 | 0.129 g/m$^2$ |
| | S-8 | 0.109 g/m$^2$ |
| | S-1 | 0.387 g/m$^2$ |
| | Gelatin | 1.076 g/m$^2$ |
| 5 | AG-3 Red sensitive Ag | 0.207 g Ag/m$^2$ |
| | C-13 | 0.423 g/m$^2$ |
| | UV-2 | 0.272 g/m$^2$ |
| | S-2 | 0.415 g/m$^2$ |
| | S-14 | 0.035 g/m$^2$ |
| | ST-4 | 0.004 g/m$^2$ |
| | Gelatin | 1.388 g/m$^2$ |
| 4 | UV-1 | 0.073 g/m$^2$ |
| | UV-2 | 0.276 g/m$^2$ |
| | ST-4 | 0.129 g/m$^2$ |
| | S-8 | 0.109 g/m$^2$ |
| | S-1 | 0.387 g/m$^2$ |
| | Gelatin | 1.076 g/m$^2$ |
| 3 | AG-2 Green sensitive Ag | 0.166 g Ag /m$^2$ |
| | M-11 | 0.323 g/m$^2$ |
| | S-1 | 0.485 g/m$^2$ |
| | ST-1 | 0.107 g/m$^2$ |
| | Gelatin | 1.270 g/m$^2$ |
| 2 | ST-4 | 0.189 g/m$^2$ |
| | S-1 | 0.567 g/m$^2$ |
| | ST-14 | 0.065 g/m$^2$ |
| | F-1 | 0.002 g/m$^2$ |
| | Gelatin | 1.130 g/m$^2$ |
| 1 | AG-1 Blue sensitive Ag | 0.269 g Ag/m$^2$ |
| | Y-3 | 0.753 g/m$^2$ |
| | P-54 | 1.076 g/m$^2$ |
| | ST-6 | 0.308 g/m$^2$ |
| | S-1 | 0.422 g/m$^2$ |
| | ST-15 | 0.009 g/m$^2$ |
| | Gelatin | 1.54 g/m$^2$ |
| Support | Polyethylene laminated paper with $TiO_2$/ZnO in the polyethylene laminated in the first layer side. | |

A coating sample 1003 is prepared by simultaneously coating the following layers on a reflective support. The blue-sensitive emulsion layer 1 comprises a loaded-latex dispersion of coupler Y-11 prepared according to the invention.

| LAYER | COMPONENT | AMOUNT |
|---|---|---|
| 7 | ST-4 | 0.021 g/m$^2$ |
| | S-1 | 0.064 g/m$^2$ |
| | F-1 | 0.009 g/m$^2$ |
| | F-2 | 0.004 g/m$^2$ |
| | Dye-1 | 0.021 g/m$^2$ |
| | Dye-2 | 0.009 g/m$^2$ |
| | Dye-3 | 0.019 g/m$^2$ |
| | Gelatin | 1.076 g/m$^2$ |
| 6 | UV-1 | 0.073 g/m$^2$ |
| | UV-2 | 0.276 g/m$^2$ |
| | ST-4 | 0.129 g/m$^2$ |
| | S-8 | 0.109 g/m$^2$ |
| | S-1 | 0.387 g/m$^2$ |
| | Gelatin | 1.076 g/m$^2$ |
| 5 | AG-3 Red sensitive Ag | 0.207 g Ag/m$^2$ |
| | C-13 | 0.423 g/m$^2$ |
| | UV-2 | 0.272 g/m$^2$ |
| | S-2 | 0.415 g/m$^2$ |
| | S-14 | 0.035 g/m$^2$ |

-continued

| LAYER | COMPONENT | AMOUNT |
|---|---|---|
| | ST-4 | 0.004 g/m$^2$ |
| | Gelatin | 1.388 g/m$^2$ |
| 4 | UV-1 | 0.073 g/m$^2$ |
| | UV-2 | 0.276 g/m$^2$ |
| | ST-4 | 0.129 g/m$^2$ |
| | S-8 | 0.109 g/m$^2$ |
| | S-1 | 0.387 g/m$^2$ |
| | Gelatin | 1.076 g/m$^2$ |
| 3 | AG-2 Green sensitive Ag | 0.166 g Ag/m$^2$ |
| | M-11 | 0.323 g/m$^2$ |
| | S-1 | 0.485 g/m$^2$ |
| | ST-1 | 0.107 g/m$^2$ |
| | Gelatin | 1.270 g/m$^2$ |
| 2 | ST-4 | 0.189 g/m$^2$ |
| | S-1 | 0.567 g/m$^2$ |
| | ST-14 | 0.065 g/m$^2$ |
| | F-1 | 0.002 g/m$^2$ |
| | Gelatin | 1.130 g/m$^2$ |
| 1 | AG-1 Blue sensitive Ag | 0.246 g Ag/m$^2$ |
| | Y-11 | 0.538 g/m$^2$ |
| | P-54 | 0.985 g/m$^2$ |
| | ST-6 | 0.237 g/m$^2$ |
| | S-1 | 0.287 g/m$^2$ |
| | ST-15 | 0.009 g/m$^2$ |
| | Gelatin | 1.54 g/m$^2$ |
| Support | Polyethylene laminated paper with $TiO_2$/ZnO in the polyethylene laminated in the first layer side. | |

Coatings 1001, 1002, and 1003 are given red, green and blue exposure and are processed using the Kodak RA-4 process. The elements show excellent color forming attributes, and show excellent image permanence. In particular, neutral color balance is preserved during fading caused by exposure to light.

Example 9

A multilayer photographic negative element is produced by coating the following layers on a cellulose triacetate film support (coverage are in grams per meter squared, emulsion sizes as determined by the disc centrifuge method and are reported in Diameter × Thickness in microns).

Layer 1 (Antihalation layer): black colloidal silver sol at 0.151; gelatin at 2.44; UV-7 at 0.075; UV-8 at 0.075; DYE-4 at 0.042; DYE-5 at 0.088; DYE-6 at 0.020; DYE-7 at 0.008 and ST-17 at 0.161.

Layer 2 (Slow cyan layer): a blend of two silver iodobromide emulsions sensitized with a 1/9 mixture of RSD-2/RSD-3: (i) a small tabular emulsion (1.1×0.09, 4.1 mol % I) at 0.430 and (ii) a very small tabular grain emulsion (0.5×0.08, 1.3 mol % I) at 0.492; gelatin at 1.78; cyan dye-forming coupler C-2 at 0.538; bleach accelerator releasing coupler B-1 at 0.038; masking coupler MC-1 at 0.027.

Layer 3 (Mid cyan layer): a red sensitized (same as above) silver iodobromide emulsion (1.3×0.12, 4.1 mol % I) at 0.699; gelatin at 1.79; C-2 at 0.204; D-6 at 0.010; MC-1 at 0.022.

Layer 4 (Fast cyan layer): a red-sensitized (same as above) tabular silver iodobromide emulsion (2.9×0.13, 4.1 mol % I) at 1.076; C-2 at 0.072; D-6 at 0.019; D-5 at 0.048; MC-1 at 0.032; gelatin at 1.42.

Layer 5 (Interlayer): gelatin at 1.29.

Layer 6 (Slow magenta layer): a blend of two silver iodobromide emulsions sensitized with a 6/1 mixture of GSD-1/GSD-2: (i) 1.0×0.09, 4.1 mol % iodide at 0.308 and (ii) 0.5×0.08, 1.3% mol % I at 0.584; magenta dye forming coupler M-5 at 0.269; masking coupler MC-2 at 0.064; stabilizer ST-5 at 0.054; gelatin at 1.72.

Layer 7 (Mid magenta layer): a green sensitized (as above) silver iodobromide emulsion: 1.3×0.12, 4.1 mol % iodide at 0.968; M-5 at 0.071; MC-2 at 0.064; D-7 at 0.024; stabilizer ST-5 at 0.014; gelatin at 1.37.

Layer 8 (Fast magenta layer): a green sensitized (as above) tabular silver iodobromide (2.3×0.13, 4.1 mol % I) emulsion at 0.968; gelatin at 1.275; Coupler M-5 at 0.060; MC-2 at 0.054; D-1 at 0.0011; D-4 at 0.0011 and stabilizer ST-5 at 0.012.

Layer 9 (Yellow filter layer): AD-1 at 0.108 and gelatin at 1.29.

Layer 10 (Slow yellow layer): a blend of three tabular silver iodobromide emulsions sensitized with sensitizing dye BSD-2: (i) 0.5×0.08, 1.3 mol % I at 0.295 (ii) 1.0×0.25, 6 mol % I at 0.50 and (iii) 0.81×0.087, 4.5 mol % I at 0.215; gelatin at 2.51; yellow dye forming couplers Y-14 at 0.725 and Y-15 at 0.289; D-3 at 0.064; C-2 at 0.027 and B-1 at 0.003.

Layer 11 (Fast yellow layer): a blend of two blue sensitized (as above) silver iodobromide emulsions: (i) a large tabular emulsion, 3.3×0.14, 4.1 mol % I at 0.227 and (ii) a 3-D emulsion, 1.1×0.4, 9 mol % I at 0.656; Y-14 at 0.725; Y-15 at 0.289; D-3 at 0.029; C-2 at 0.048; B-1 at 0.007 and gelatin at 2.57.

Layer 12 (UV filterlayer): gelatin at 0.699; silver bromide Lippman emulsion at 0.215; UV-7 at 0.011 and UV-8 at 0.011.

Layer 13 (Protective overcoat): gelatin at 0.882.

Hardener bis(vinylsulfonyl)methane hardener at 1.75% of total gelatin weight), antifogants (including 4-hydroxy-6-methyl-1,3,3a,7-tetraazaindene), surfactants, coating aids, emulsion addenda, sequestrants, lubricants, matte and tinting dyes are added to the appropriate layers as is common in the art.

DYE-4:

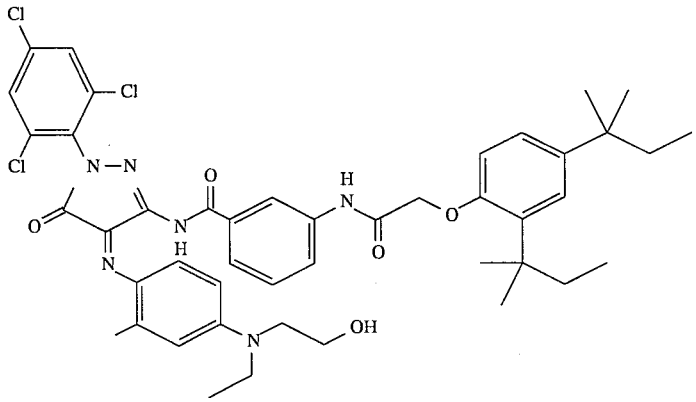

DYE-5:

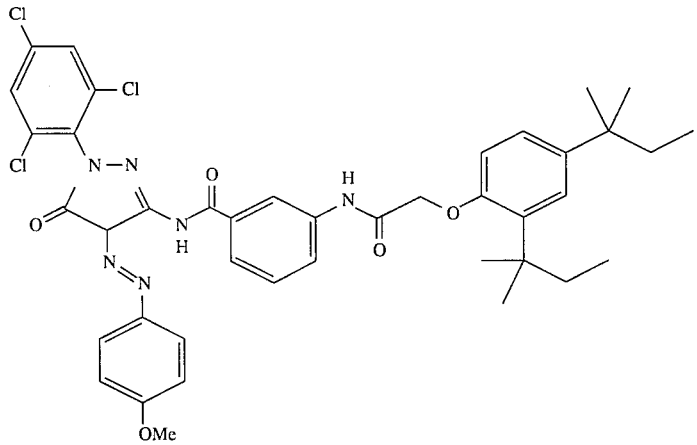

-continued
DYE-6:
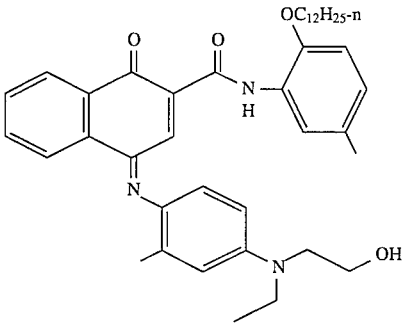
DYE-7:
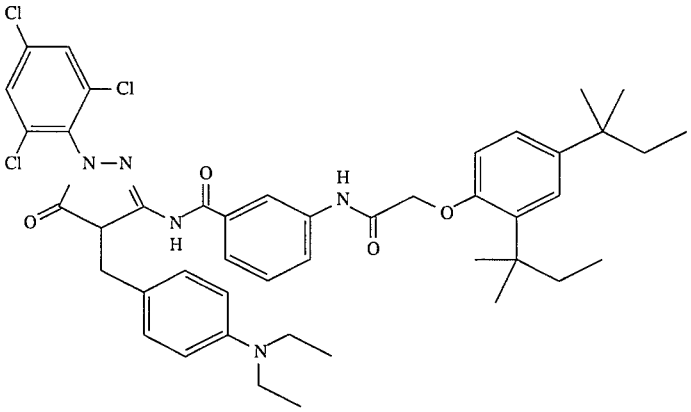
B-1:
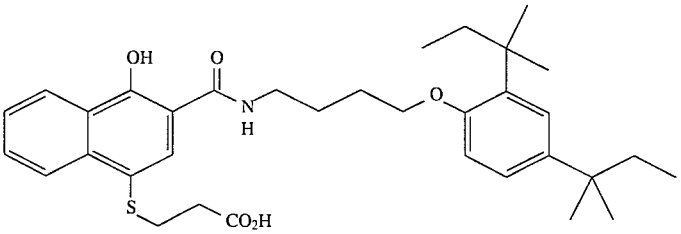
MC-1:
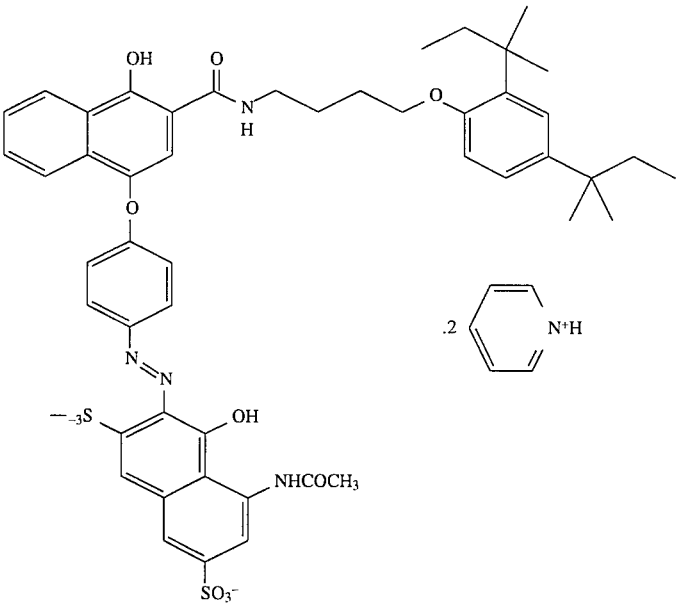

-continued
MC-2:
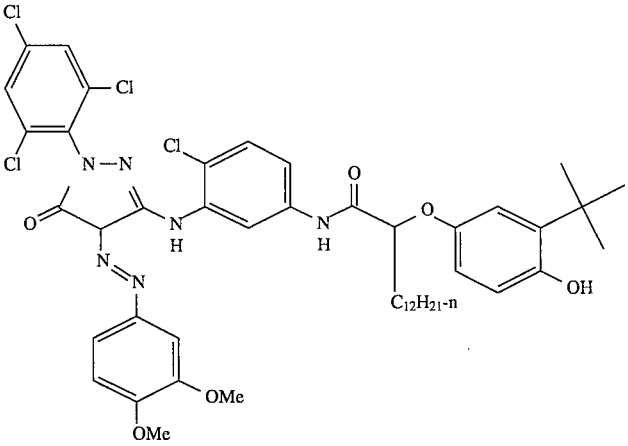
AD-1
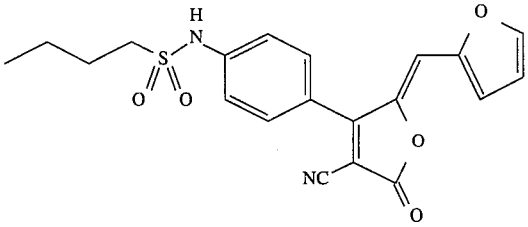
RSD-2:
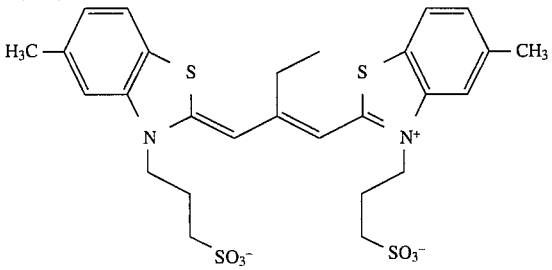
RSD-3:
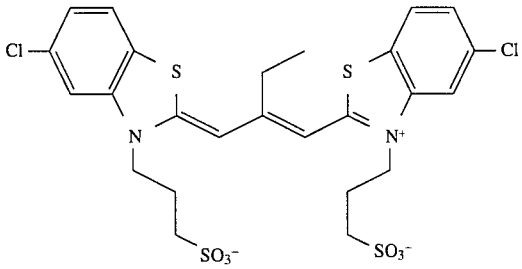
GSD-1:
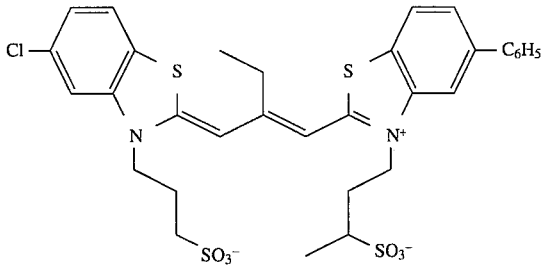

-continued

GSD-2:

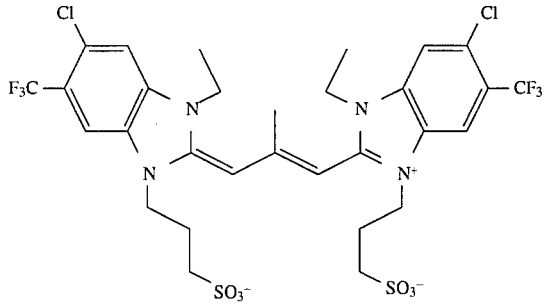

BSD-2:

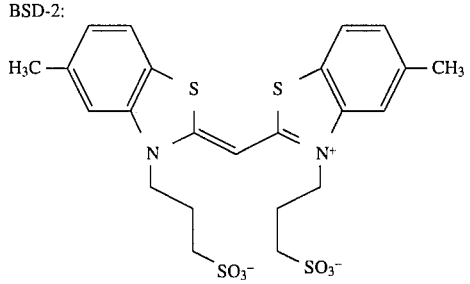

Additional coating samples are prepared similarly using dispersions of the invention comprising polymer P-17 and polymer P-54 with couplers C-2, Y-14, Y-15, and M-5. Polymer:Coupler ratios in the dispersions range from 0.5:1.0 to 5.0:1.0. The dispersions of the invention show lower turbidity than the comparison dispersions, indicating smaller dispersion particle size. The photographic elements of the invention exhibit improved performance in many cases, including enhanced sensitometric performance, improved image permanence and greater physical durability.

While the invention has been described in detail and with reference to specific embodiments thereof, it will be apparent to one skilled in the art that various changes and modifications can be made therein without departing from the spirit and scope thereof.

What is claimed:

1. A method for preparing a photographic element comprising at least one hydrophilic colloid layer coated on a support, comprising:

(a) combining under conditions of low or moderate shear, in the presence of surfactant, and in the substantial absence of water-miscible or volatile organic solvents, a liquid organic composition comprising at least one photographically useful compound with an aqueous polymer latex, (b) holding the combination resulting from (a) in a liquid state for sufficient time for substantial loading of the organic composition into the polymer latex to occur, and (c) coating the loaded latex resulting from (b) on a support.

2. The method of claim 1 wherein the combination resulting from (a) is held for a sufficient time for essentially complete loading of the organic composition into the polymer latex to occur.

3. The process of claim 1 wherein the liquid organic composition is formed by combining one or more hydrophobic photographically useful compounds with one or more high-boiling solvents at a temperature sufficient to prepare a homogeneous organic solution, and the organic solution is then mixed with an aqueous solution containing gelatin, surfactant, and the polymer latex.

4. The process of claim 1 wherein the liquid organic composition is first combined with an aqueous solution containing gelatin and surfactant to form an aqueous dispersion off the liquid organic composition, and the resulting dispersion is then combined with another aqueous solution containing the polymer latex.

5. The method of claim 4 wherein the aqueous dispersion of a liquid organic composition has an average particle size of between 0.4 and 20 microns.

6. The method of claim 4 wherein the aqueous dispersion of a liquid organic composition has an average particle size of between 0.05 and 0.4 microns.

7. The method of claim 1 wherein gelatin is also combined with the liquid organic composition and the polymer latex, the polymer has a glass transition temperature (Tg) of 60° C. or more, and the combination resulting from (a) is held for at least 1 hour in a liquid state below 60° C. before coating on the support.

8. The method of claim 7 wherein the polymer has a Tg of 90° C. or more.

9. The method of claim 8, wherein the combination resulting from (a) is held for at least 2 hours in a liquid state below 60° C. before coating on the support.

10. The method of claim 9, wherein the combination resulting from (a) is held for at least 3 hours in a liquid state below 60° C. before coating on the support.

11. The method of claim 1 wherein the polymer latex has an average particle size less than 0.20 microns.

12. The method of claim 1 wherein the liquid organic composition comprises a photographically useful compound with a logP less than about 9.0.

13. The method of claim 12 wherein the liquid organic composition comprises a photographic coupler.

14. The method of claim 1 wherein the liquid organic composition comprises a photographic coupler.

15. The method of claim 14 wherein the liquid organic composition comprises a yellow photographic coupler.

16. The method of claim 15 wherein the liquid organic composition comprises an acetanilide photographic coupler.

17. The method of claim 16 wherein the liquid organic composition comprises an pivaloylacetanilide photographic coupler.

18. The method of claim 1 wherein the liquid organic composition comprises a cyan photographic coupler.

19. The method of claim 1 wherein the liquid organic composition comprises a UV absorber.

20. The method of claim 1 wherein the liquid organic composition comprises a photographic coupler and a bisphenol compound.

21. The method of claim 1 wherein the aqueous polymer latex is not stable toward mixing with an equal volume of water-miscible organic solvent, chosen from acetone, tetrahydrofuran, dimethylformamide, or acetonitrile.

22. The method of claim 1 wherein the polymer latex has a $T_g$ greater than about 60° C.

23. The method of claim 1 wherein the polymer latex has a $T_g$ greater than about 90° C.

24. The method of claim 1 wherein the polymer latex comprises at least 50% N-alkylacrylamide monomer units.

25. The method of claim 1 wherein the polymer latex is a poly(t-butylacrylamide) polymer latex.

26. The method of claim 1 wherein the aqueous polymer latex is prepared by free-radical emulsion polymerization of one or more vinyl monomers in the substantial absence of any volatile or water-miscible organic solvent.

* * * * *